US010803810B2

(12) United States Patent
Takasugi

(10) Patent No.: US 10,803,810 B2
(45) Date of Patent: Oct. 13, 2020

(54) DISPLAY DEVICE HAVING BLACK IMAGE INSERTING FUNCTION

(71) Applicant: LG DISPLAY CO., LTD., Seoul (KR)

(72) Inventor: Shinji Takasugi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/565,367

(22) Filed: Sep. 9, 2019

(65) Prior Publication Data

US 2020/0082762 A1 Mar. 12, 2020

(30) Foreign Application Priority Data

Sep. 10, 2018 (KR) ..... 10-2018-0107644

(51) Int. Cl.
*G09G 3/3266* (2016.01)
*G09G 3/34* (2006.01)
*G09G 3/00* (2006.01)

(52) U.S. Cl.
CPC ..... *G09G 3/3266* (2013.01); *G09G 3/003* (2013.01); *G09G 3/342* (2013.01); *G09G 2310/062* (2013.01); *G09G 2310/067* (2013.01); *G09G 2310/08* (2013.01)

(58) Field of Classification Search
CPC ..... G09G 3/3266; G09G 3/003; G09G 3/342; G09G 2310/062; G09G 2310/067; G09G 2310/08
See application file for complete search history.

(56) References Cited

U.S. PATENT DOCUMENTS

2007/0146384 A1* 6/2007 Jo ..... G09G 3/20 345/589
2016/0049112 A1* 2/2016 Jung ..... G09G 3/2003 345/694
2018/0108299 A1* 4/2018 Nakamura ..... G09G 3/3233

* cited by examiner

*Primary Examiner* — Abhishek Sarma
(74) *Attorney, Agent, or Firm* — Seed IP Law Group LLP

(57) ABSTRACT

Provided is a display device including a display panel, a data driver, a gate driver, and a timing controller. The display panel includes first and second pixel line groups each including k (k is a natural greater than 1) pixel lines, and each of the pixel lines includes a plurality of pixels connected to the same gate line. The data driver supplies an image data voltage to the pixels on the basis of input image data. The gate driver supplies a gate pulse to the gate line. The timing controller controls a driving timing of the data driver and the gate driver, sequentially writes the image data voltage into pixel lines belonging to the first pixel line group during an image data write period and simultaneously writes a black data voltage into pixel lines belonging to the second pixel line group during a black data insertion (BDI) period. The timing controller changes an interval between timings for writing the black data voltage from a start timing of a frame on a frame-by-frame basis.

9 Claims, 49 Drawing Sheets

FIG. 17

| Line # | CRCLK | SCCLK/SECLK |
|---|---|---|
| 1 | A1 | A1 |
| 2 | A2 | A2 |
| 3 | A3 | A3 |
| 4 | A4 | A4 |
| 5 | A5 | A5 |
| 6 | A6 | A6 |
| 7 | A7 | A7 |
| 8 | A8 | A8 |
| 9 | A1 | A1 |
| 10 | A2 | A2 |
| 11 | A3 | A3 |
| 12 | A4 | A4 |
| 13 | A5 | A5 |
| 14 | A6 | A6 |
| 15 | A7 | A7 |
| 16 | A8 | A8 |
| 17 | B1 | B1 |
| 18 | B2 | B2 |
| 19 | B3 | B3 |
| 20 | B4 | B4 |
| 21 | B5 | B5 |
| 22 | B6 | B6 |
| 23 | B7 | B7 |
| 24 | B8 | B8 |
| 25 | B1 | B1 |
| 26 | B2 | B2 |
| 27 | B3 | B3 |
| 28 | B4 | B4 |
| 29 | B5 | B5 |
| 30 | B6 | B6 |
| 31 | B7 | B7 |
| 32 | B8 | B8 |

region A region B clock group A clock group B unit repetition

| Line # | CRCLK | SCCLK/SECLK |
|---|---|---|
| 1073 | B1 | B1 |
| 1074 | B2 | B2 |
| 1075 | B3 | B3 |
| 1076 | B4 | B4 |
| 1077 | B5 | B5 |
| 1078 | B6 | B6 |
| 1079 | B7 | B7 |
| 1080 | B8 | B8 |
| 1081 | B1 | B1 |
| 1082 | B2 | B2 |
| 1083 | B3 | B3 |
| 1084 | B4 | B4 |
| 1085 | B5 | B5 |
| 1086 | B6 | B6 |
| 1087 | B7 | B7 |
| 1088 | B8 | B8 |
| 1089 | A1 | A1 |
| 1090 | A2 | A2 |
| 1091 | A3 | A3 |
| 1092 | A4 | A4 |
| 1093 | A5 | A5 |
| 1094 | A6 | A6 |
| 1095 | A7 | A7 |
| 1096 | A8 | A8 |
| 1097 | A1 | A1 |
| 1098 | A2 | A2 |
| 1099 | A3 | A3 |
| 1100 | A4 | A4 |
| 1101 | A5 | A5 |
| 1102 | A6 | A6 |
| 1103 | A7 | A7 |
| 1104 | A8 | A8 |

region B region A clock group B clock group A

CLK is separated

DISPLAY DEVICE HAVING BLACK IMAGE INSERTING FUNCTION

CROSS-REFERENCE TO RELATED APPLICATION(S)

This application claims the benefit of Korea Patent Application No. 10-2018-0107644 filed on Sep. 10, 2018, the entire contents of which is incorporated herein by reference for all purposes as if fully set forth herein.

BACKGROUND

Technical Field

The present disclosure relates to a display device having a black image inserting function.

Description of the Related Art

Display devices have extensively been used in portable computers such as notebook computers or personal digital assistants (PDAs) or in mobile phone terminals, and the like, as well as in monitors of desktop computers, due to advantages of miniaturization and a reduced weight. Such display devices include a liquid crystal display (LCD), a plasma display panel (PDP), and an organic light emitting display device, and the like. In particular, an active matrix type organic light emitting display device includes a self-luminous organic light emitting diode (OLED) and has a high response speed, high luminous efficiency, a high contrast, and a wide viewing angle.

Recently, a technique of inserting a black image in order to shorten a motion picture response time (MPRT) in an organic light emitting display device has been proposed. The black image inserting technique is to effectively erasing an image of a previous frame by displaying a black image between neighboring image frames.

BRIEF SUMMARY

In one embodiment, a display device includes a display panel, a data driver, a gate driver, and a timing controller. The display panel has a plurality of pixel lines defined by a plurality of pixels connected to the same gate line. The data driver supplies an image data voltage to the pixels on the basis of input image data. The gate driver supplies a gate pulse to gate lines. The timing controller controls operations of the data driver and the gate driver to sequentially write an image data voltages to n (n is a natural number greater than 1) pixel lines and to simultaneously or concurrently write a black data voltage to other n pixel lines. The timing controller changes an interval between a start timing of a frame and a timing of writing the black data voltage on a frame-by-frame basis.

BRIEF DESCRIPTION OF THE SEVERAL VIEWS OF THE DRAWINGS

FIGS. 17 and 18 are views illustrating connection of a gate clock and a stage according to an embodiment.

DETAILED DESCRIPTION

Figure 1:
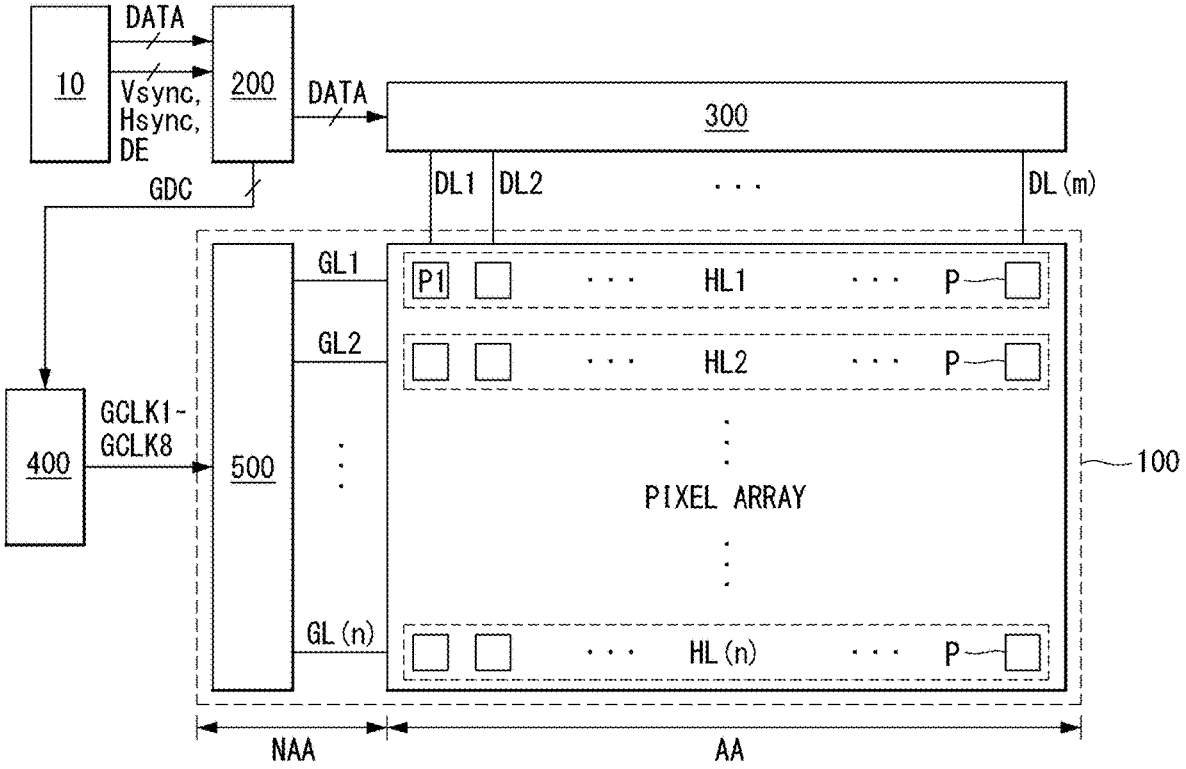
FIG. 1 is a view illustrating a display device according to embodiments of the present disclosure.

Advantages and features of various embodiments of the present disclosure, and implementation methods thereof will be clarified through following embodiments described with reference to the accompanying drawings. The various embodiments of the present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

In this disclosure, a pixel circuit and a gate driver formed on a substrate of a display panel may be realized as a thin film transistor (TFT) having an n-type metal oxide semiconductor field effect transistor (MOSFET) structure, but without being limited thereto, the pixel circuit and a gate driver may also be realized as a TFT having a p-type MOSFET structure. A TFT is a three-electrode element including a gate, a source, and a drain. The source is an electrode that supplies a carrier to a transistor. In the TFT, carriers start to flow from the source. The drain is an electrode through which the carriers exit from the TFT. That is, in the MOSFET, the carriers flow from the source to the drain. In the case of the n-type TFT, the carriers are electrons, and thus, a source voltage has a voltage lower than a drain voltage so that electrons may flow from the source to the drain. In the n-type TFT, electrons flow from the source to the drain, and thus, current flows from the drain to the source. In contrast, in the case of a p-type TFT (PMOS), since carriers are holes, a source voltage is higher than a drain voltage so that holes may flow from the source to the drain. In the p-type TFT, since holes flow from the source to the drain, current flows from the source to the drain. It should be noted that the source and the drain of the MOSFET are not fixed. For example, the source and the drain of the MOSFET may be changed depending on the applied voltage. Therefore, in the description of the embodiments, one of the source and the drain is referred to as a first electrode and the other is referred to as a second electrode.

Hereinafter, embodiments of the present disclosure will be described in detail below with reference to the accompanying drawings. In the following embodiments, display device will be described focusing on an organic light emitting display device including an organic light emitting material. However, it should be noted that embodiments of the present disclosure are not limited to the organic light emitting display device and may be applied to an inorganic light emitting display device including an inorganic light emitting material.

In the following description, if a detailed explanation for a related known function or construction is considered to unnecessarily divert the gist of the present disclosure, such explanation has been omitted but would be understood by those skilled in the art.

FIG. 1 is a block diagram schematically illustrating an organic light emitting display device.

Referring to FIG. 1, an organic light emitting display device according to an embodiment of the present disclosure includes a display panel 100 in which pixels P are formed, a timing controller 200 for generating a timing control signal, gate drivers 400 and 500 for driving gate lines GL1 to GLn and a data driver 300 for driving data lines DL1 to DLm.

The display panel 100 includes a display area AA in which pixels P are arranged to display an image and a non-display area NAA in which no image is displayed. A shift register 500 may be disposed in the non-display area NAA. In the drawing, the non-display area NAA indicates the area where the shift register 500 is disposed but the non-display area NAA refers to a bezel surrounding the edge of the pixel array.

A plurality of data lines DL1 to DLm and a plurality of gate lines GL1 to GLn overlap each other in the display area AA of the display panel 100 and pixels P are arranged in a matrix form. Each of the pixel lines HL1 to HLn includes pixels arranged in the same row. When the number of pixels P arranged in the display area AA is m×n, the display area AA includes n pixel lines.

The pixels P arranged in the first pixel line HL1 are connected to the first gate line GL1 and the pixels P arranged in the nth pixel line HLn are connected to the nth gate line GLn. The gate lines GL1 to GLn may include a plurality of lines respectively providing gate signals.

The timing controller 200 rearranges input image data DATA provided from a host 10 according to resolution of the display panel 100 and supplies the same to the data driver 300. Also, the timing controller 200 generates a data control signal for controlling an operation timing of the data driver 300 on the basis of timing signals such as a vertical synchronization signal Vsync, a horizontal synchronization signal Hsync, a data enable signal DE, and the like.

The timing controller 200 may vary a black data insertion period at every predetermined period by adjusting a gate timing control signal, thereby improving the phenomenon of concentration of brightness deviation in a specific pixel line. Details thereof will be described later.

The timing controller 200 may control a display driving timing and a sensing driving timing of the pixel lines of the display panel 100 on the basis of the timing control signals so that driving characteristics of pixels may be sensed in real time during image displaying.

Also, the timing controller 200 may change a timing for writing a data voltage for sensing (or a sensing data voltage) in each frame so that a period for writing data for sensing and a period for writing a black image do not overlap each other.

Display driving refers to driving to sequentially reproduce an input image and a black image in the display panel 100, while writing input image data (or image data voltage) and black image data (or black data voltage) into pixel lines with a predetermined time difference therebetween in one frame. Display driving includes image data write driving (hereinafter, referred to as IDW driving) for writing input image data to pixel lines and black data write driving (black data insertion (BDI) driving) for writing black image data into pixel lines. Black data write driving is to display a black image between neighboring image frames to effectively erase an image of a previous frame. BDI driving may start before the IDW driving is completed in one frame so that a display device optimized for high-speed driving may be implemented. More specifically, image data write driving may be performed on a first pixel line group including a plurality of pixel lines in one frame and BDI driving may be performed on a second pixel line group in the corresponding frame. That is, IDW driving for the first pixel line and BDI driving for the second pixel line may be performed in a temporally overlapping manner in one frame.

Sensing driving refers to driving to write sensing data into the pixels P arranged in a specific pixel line to sense driving characteristics of the pixels P update a compensation value for compensating for a change in the driving characteristics of the corresponding pixels P on the basis of the sensing result. Hereinafter, an operation of writing the sensing data into the pixels P arranged in the specific pixel line in the sensing driving will be referred to as sensing data write (SDW) driving.

The data driver 300 converts the input image data DATA provided from the timing controller 200 into an analog data voltage on the basis of the data control signal.

The gate drivers 400 and 500 include a level shifter 400 and a shift register 500. The level shifter 400 generates gate clocks on the basis of a gate control signal GDC provided from the timing controller 200. The gate clocks may include a scan clock SCCLK, a sense clock SECLK, and a carry clock CRCLK according to an embodiment. The shift register 500 generates gate signals, while sequentially shifting the gate clocks output from the level shifter 400. A specific timing of the gate clocks will be described on the basis of an embodiment of the pixels described later. The shift register 500 may be formed directly on the non-display area NAA of the display panel 100 using a gate-driver in panel (GIP) process.

Figure 2:
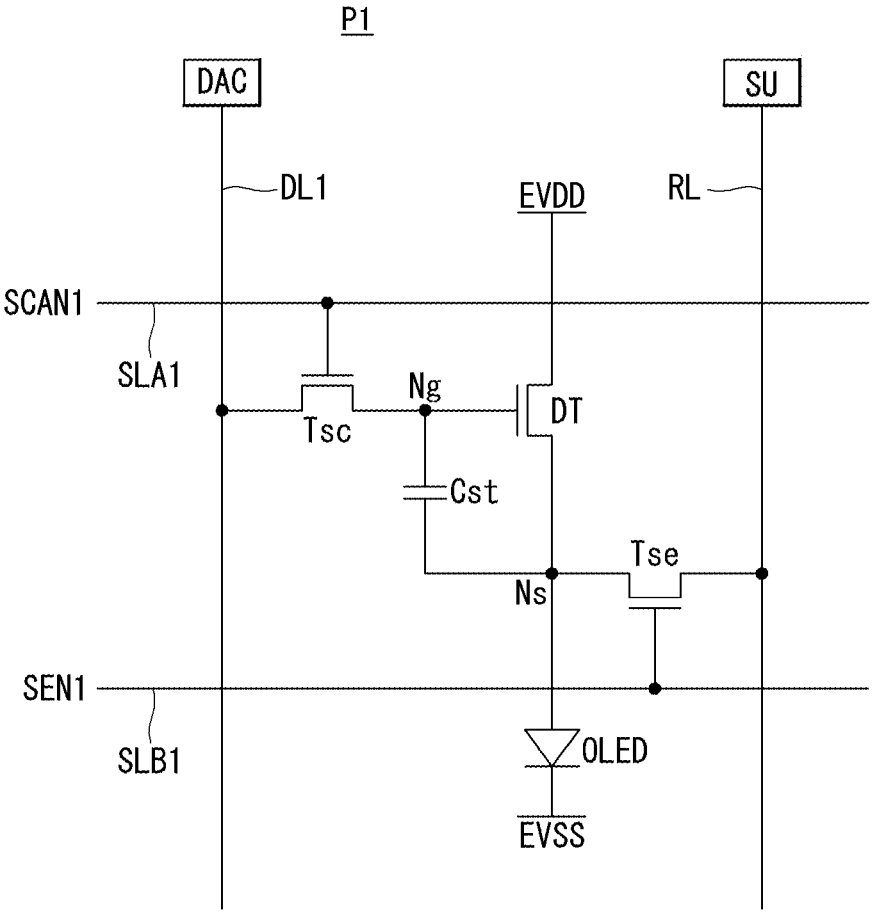
FIG. 2 is a view illustrating a pixel structure according to a first embodiment.

FIG. 2 is a view illustrating an embodiment of a pixel according to a first embodiment. FIG. 2 shows a pixel connected to a first data line among the pixels arranged in the first pixel line. In the first embodiment illustrated in FIG. 2, the gate line includes a scan line for applying a scan signal and a sense line for applying a sense signal.

Referring to FIG. 2, a first pixel P1 includes a first organic light emitting diode OLED, a driving transistor DT, a storage capacitor Cst, a scan transistor Tsc, and a sense transistor Tse. The driving transistor DT controls a driving current flowing at the organic light emitting diode OLED according to a gate-source voltage Vgs. The driving transistor DT includes a gate electrode connected to a first node Ng, a drain electrode connected to an input terminal of a high potential driving voltage EVDD, and a source electrode connected to a second node Ns. The storage capacitor Cst is connected between the first node Ng and the second node Ns. The scan transistor Tsc includes a gate electrode connected to a first scan line SLA, a drain electrode connected to a first data line DL, and a source electrode connected to the first node Ng. The sense transistor Tse includes a gate electrode connected to a first sense line SLB1, a drain electrode connected to the second node Ns, and a source electrode connected to a reference voltage line RL.

The first data line DL1 is supplied with a data voltage through a digital-to-analog converter (DAC) of the data driver 300, and the reference voltage line RL is connected to a sensing unit SU. The sensing unit SU supplies a reference voltage through the reference voltage RL of the pixel or acquires a first node Ng voltage of each of the pixels, as a sensing voltage.

In the organic light emitting display device according to the present disclosure, a technique of inserting a black image may be applied to shorten a moving picture response time (MPRT).

Figure 3:
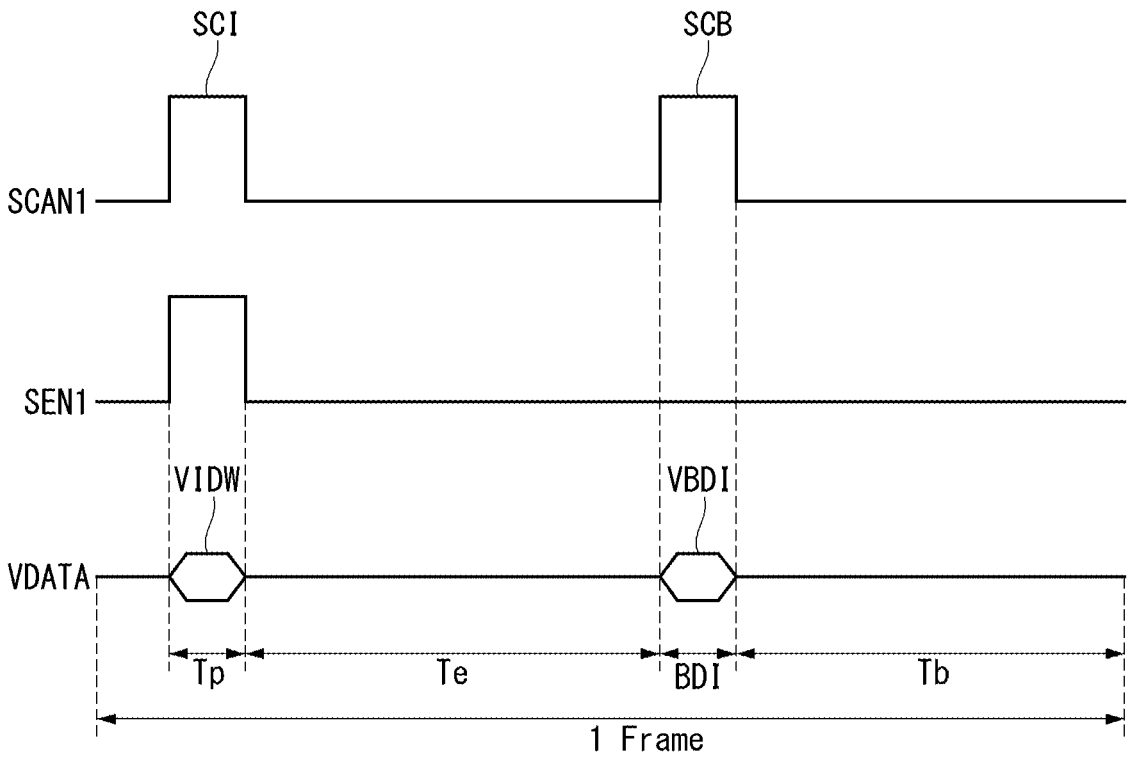
FIG. 3 is a view illustrating a gate signal for driving a pixel illustrated in FIG. 2.
Figure 4A:
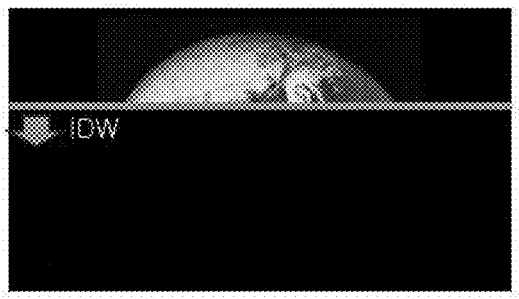
FIGS. 4A, 4B, 4C, 4D, 5, and 6 are views illustrating a black image inserting technique.
Figure 4B:
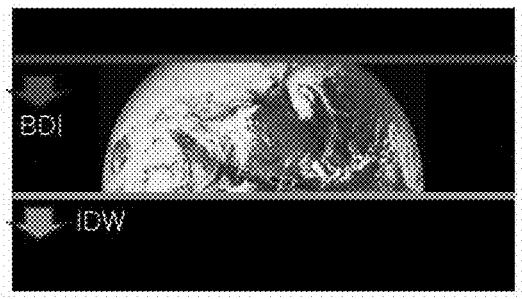
Figure 4C:
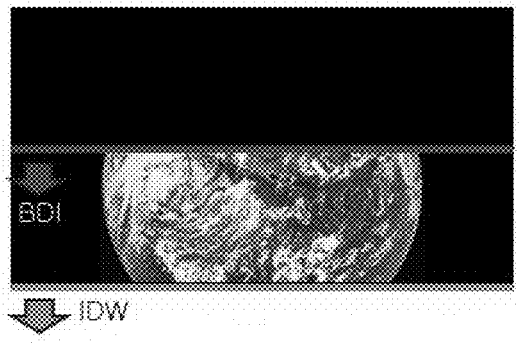
Figure 4D:
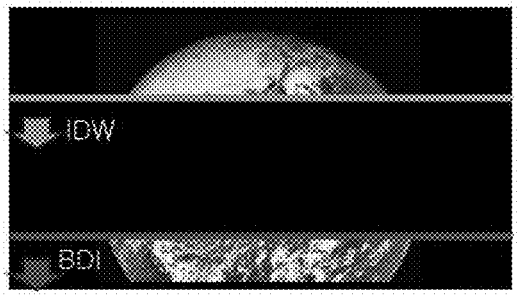
Figure 5:
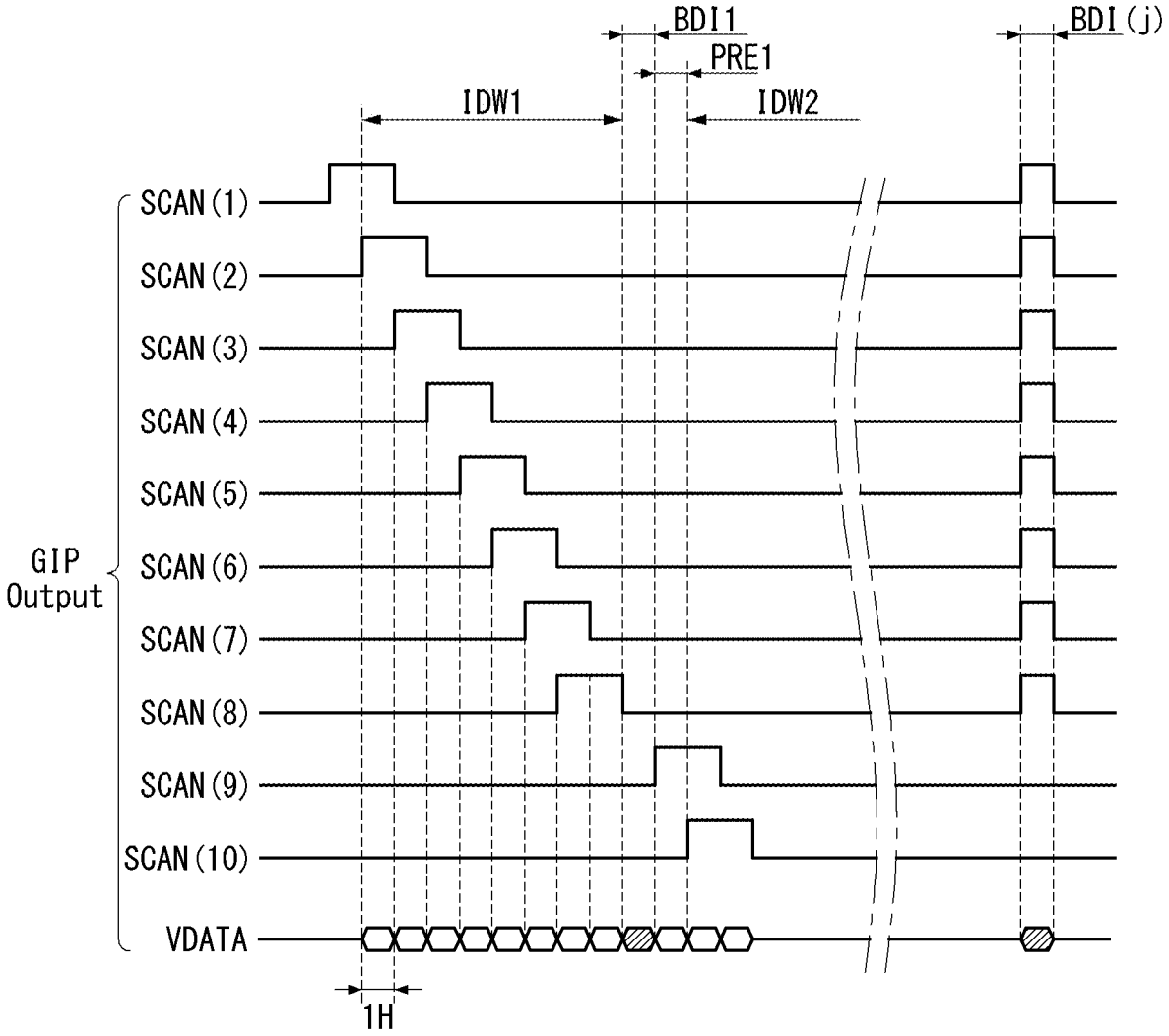
Figure 6:
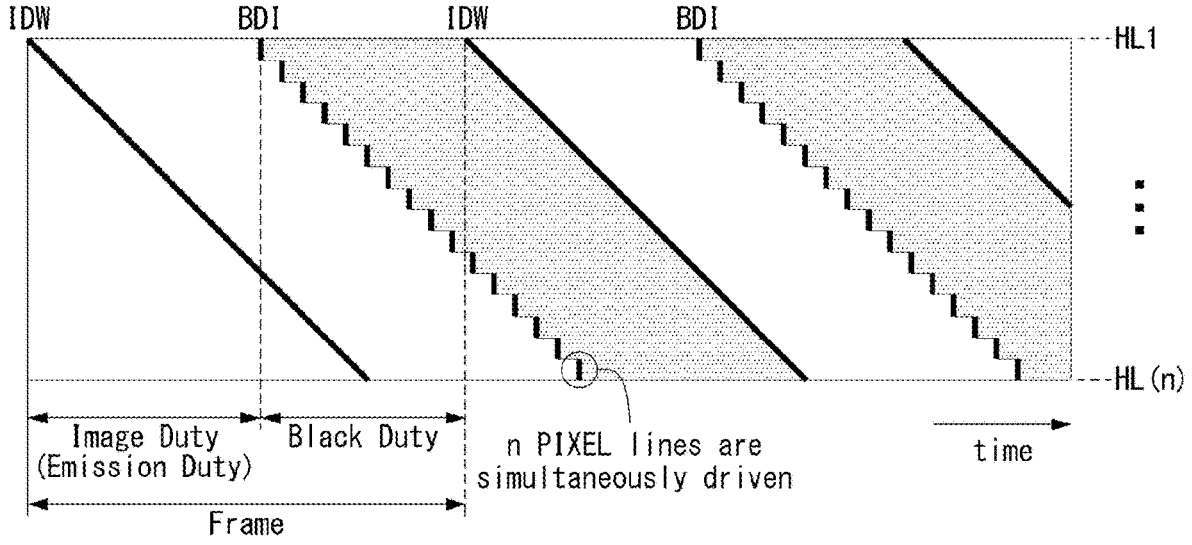

FIG. 3 is a view illustrating a scan signal and a sense signal applied to the first pixel line. FIGS. 4A, 4B, 4C, and 4D are views illustrating a BDI driving method. FIG. 5 is a timing chart of first through tenth scan signals for BDI driving. FIG. 6 is a view illustrating a timing at which scan signals for BDI driving are applied, in units of frames.

BDI driving of the pixels connected to the first data line will be described with reference to FIGS. 3 to 6.

Referring to FIG. 3, the first scan signal SCAN1 and the first sense signal SEN1 are set to an output period of 1H or more and overlap driving is performed. The output period of the first scan signal SCAN1 and the first sense signal SEN1 refers to a period maintained at a turn-on voltage. The 1H period refers to a period of writing a data voltage into the pixels arranged in one pixel line HL. Each of the scan signals SCAN includes a scan signal SCI for an image (or an image scan signal SCI) and a scan signal SCB for BDI (or a BDI scan signal SCB). The image scan signal SCI is synchronized with a timing for writing an image data voltage in IDW driving or a timing for writing a data voltage for sensing in SDW driving. The BDI scan signal SCB is synchronized with a timing for writing a black image in BDI driving.

Referring to FIGS. 4A, 4B, 4C, and 4D, IDW driving and BDI driving are consecutively performed with a certain time difference within one frame. An emission duty of the pixels PXL is determined based on a time difference between a start timing of IDW driving and a start timing of BDI driving within the same frame. The start timing of BDI driving is an adjustable driving factor. The start timing of IDW driving is determined based on a timing of the data write scan signal SCI, and the start timing of BDI driving is determined by the BDI scan signal SCB. Therefore, the emission duty of the pixels PXL may be controlled by adjusting the start timing of BDI driving by advancing or delaying the output timing of the BDI scan signal SCB and. In other words, if the output timing of the BDI scan signal SCB is delayed, the emission duty increases and the black duty decreases. If the output timing of the BDI scan signal SCB is advanced, the emission duty decreases and the black duty increases. When a time from the timing of the data write scan signal SCI to the timing of the BDI scan signal SCB is maintained, the emission duty of the pixels PXL is maintained regardless of frame change. That is, the IDW driving timing and the BDI driving timing for the pixel lines are equally shifted as illustrated in FIG. 6, while maintaining the emission duty over time. The time from the timing of the data write scan signal SCI to the timing of the BDI scan signal SCB may be changed according to display contents.

For example, during a first image data write period IDW1, data write scan signals SCI of first to eighth scan signals SCAN1 to SCAN8 are sequentially applied to the display panel 100. The first scan signal SCAN1 is applied to the first scan line SLA1 and the second scan signal SCAN2 is applied to the second scan line SLA2. Similarly, the eighth scan signal SCAN8 is applied to the eighth scan line SLAB. During the first image data write period IDW1, a data voltage VDATA for image display is supplied to the first data line DL1 in synchronization with the data write scan signals SCI.

During a first BDI interval BDI1 of a 1H period, the BDI scan signals SCB are simultaneously or concurrently applied to the eight contiguous pixel lines. The BDI scan signals applied to first to eighth pixel lines HL1 to HL8 may be applied during the BDI interval BDI(j) (j is a certain natural number equal to or smaller than "n/8"). During the BDI interval, a black data voltage for displaying a black image is applied to the data line DL.

A first precharge interval PRE1 of the 1H period is an interval for precharging a ninth pixel line HL9 using a ninth scan signal SCAN9.

The operation of the first pixel during a programming interval Tp, a light emission interval Te, and the BDI interval BDI will be described.

Figure 7:
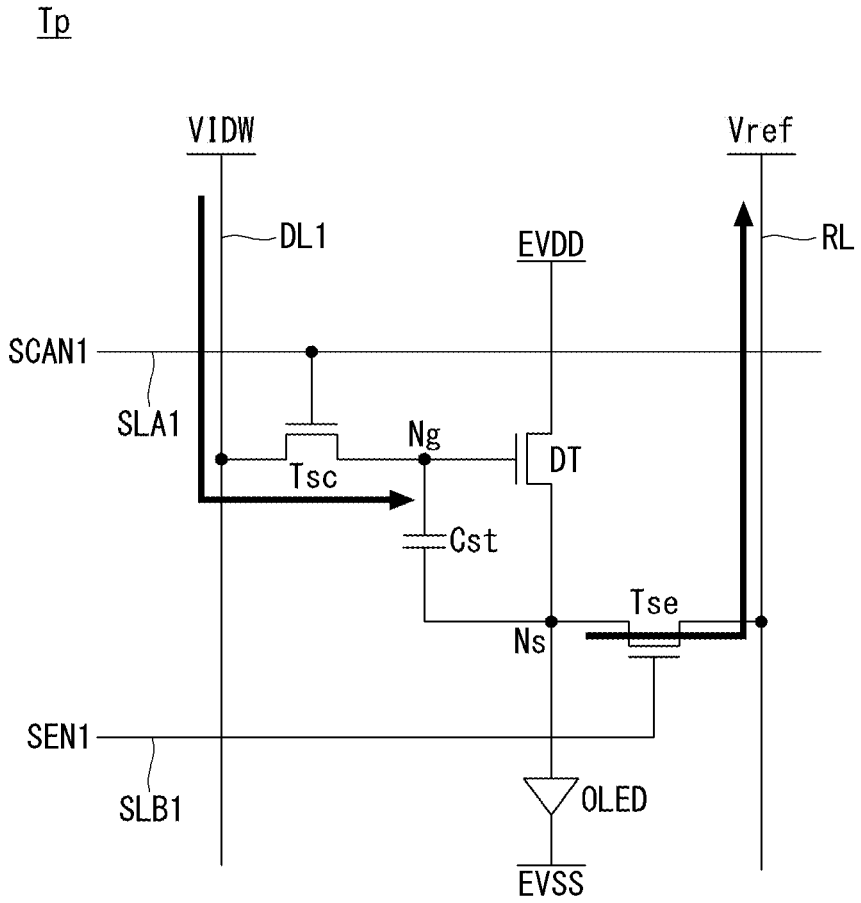
FIGS. 7 to 9 are equivalent circuit views of pixels corresponding to a programming period, an emission period, and a black image insertion period, respectively.
Figure 8:
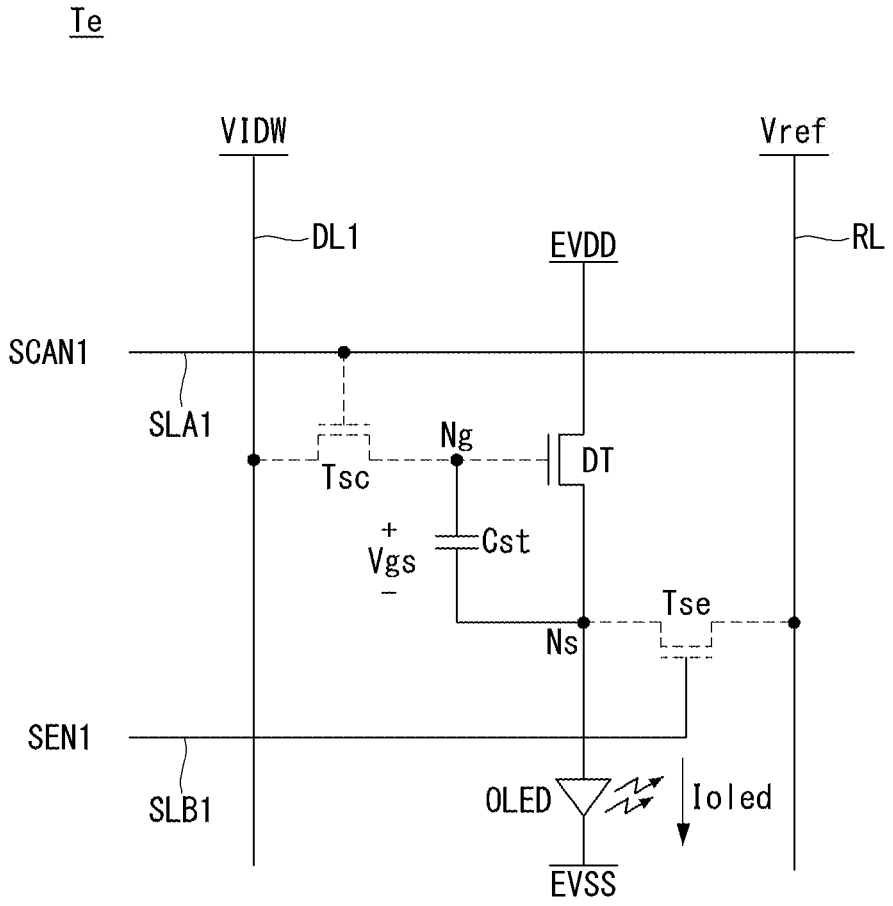
Figure 9:
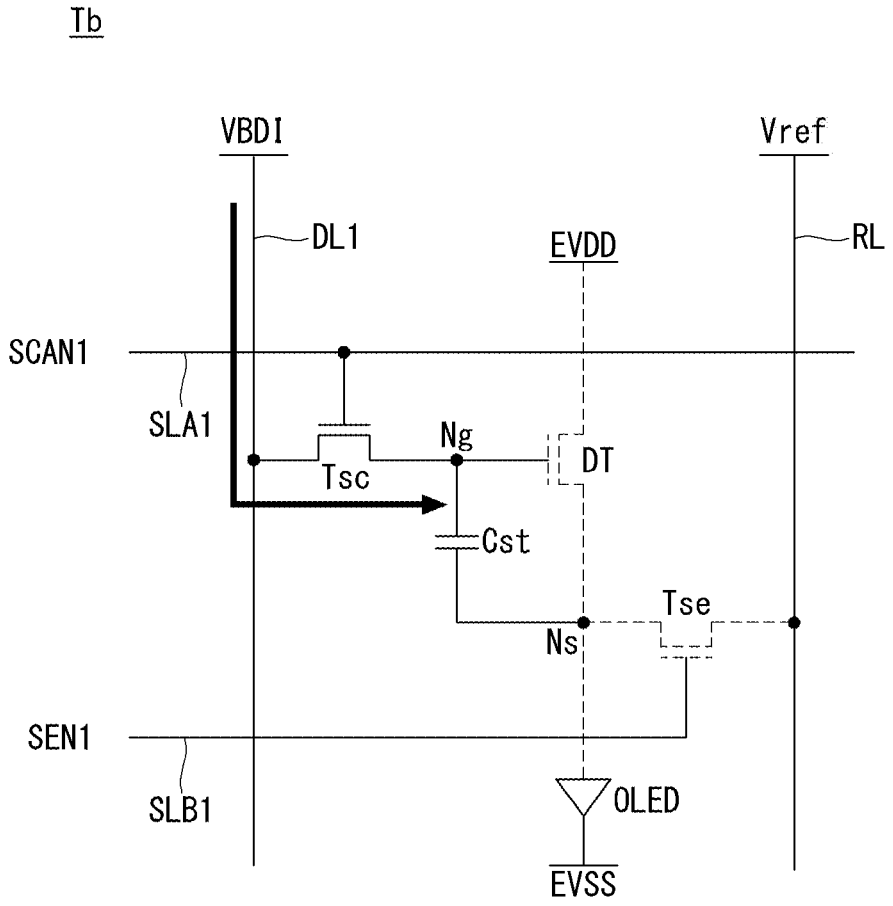

FIG. 7 is an equivalent circuit diagram of the first pixel corresponding to the programming interval, and FIG. 8 is an equivalent circuit diagram of the first pixel corresponding to the light emission interval. FIG. 9 is an equivalent circuit diagram of the first pixel corresponding to the black data insertion interval.

Referring to FIGS. 3 and 7, during the programming interval Tp, the scan transistor Tsc applies a data voltage VIDW for image data writing to the first node Ng in response to the scan signal SCI for image data writing. During the programming interval Tp, the sense transistor Tse is turned on according to the sense signal SEN to apply a reference voltage Vref to the second node Ns. Accordingly, during the programming interval Tp, a voltage between the first node Ng and the second node Ns of the pixel P is set to fit a desired pixel current.

Referring to FIGS. 3 and 8, during the light emission interval Te, the scan transistor Tsc and the sense transistor Tse are turned off. The voltage Vgs between the first node Ng and the second node Ns of the pixel P in the programming interval Tp is also maintained during the light emission interval Te. Since the voltage Vgs between the first node Ng and the second node Ns is larger than a threshold voltage of the driving transistor DT, a pixel current Ioled flows at the driving transistor DT. A potential of the first node Ng and a potential of the second node Ns are boosted, while maintaining the preset magnitude of "Vgs", by the pixel current Ioled during the light emission interval Te. When the potential of the second node Ns is boosted up to an operating point level of the organic light emitting diode OLED, the organic light emitting diode OLED emits light.

Referring to FIGS. 3 and 9, during the BDI interval Tb, the scan transistor Tsc is turned on in response to the BDI scan signal SCB to apply a data voltage VBDI for BDI to the first node Ng. During the BDI interval Tb, the sense transistor Tse maintains the turn-off state, and thus, the potential of the second node Ns maintains the operating point level of the organic light emitting diode OLED. The data voltage VBDI for BDI is lower than the operating point level of the organic light emitting diode OLED. Therefore, since the voltage Vgs between the first node Ng and the second node Ns is smaller than the threshold voltage of the driving transistor DT1 during the BDI interval Tb, the pixel current holed does not flow at the driving transistor DT of the pixel P and the organic light emitting diode OLED stops emitting light.

The structure for preventing data collision in IDW driving and BDI driving using the gate signal illustrated in FIG. 3 will be described below.

Figure 10:
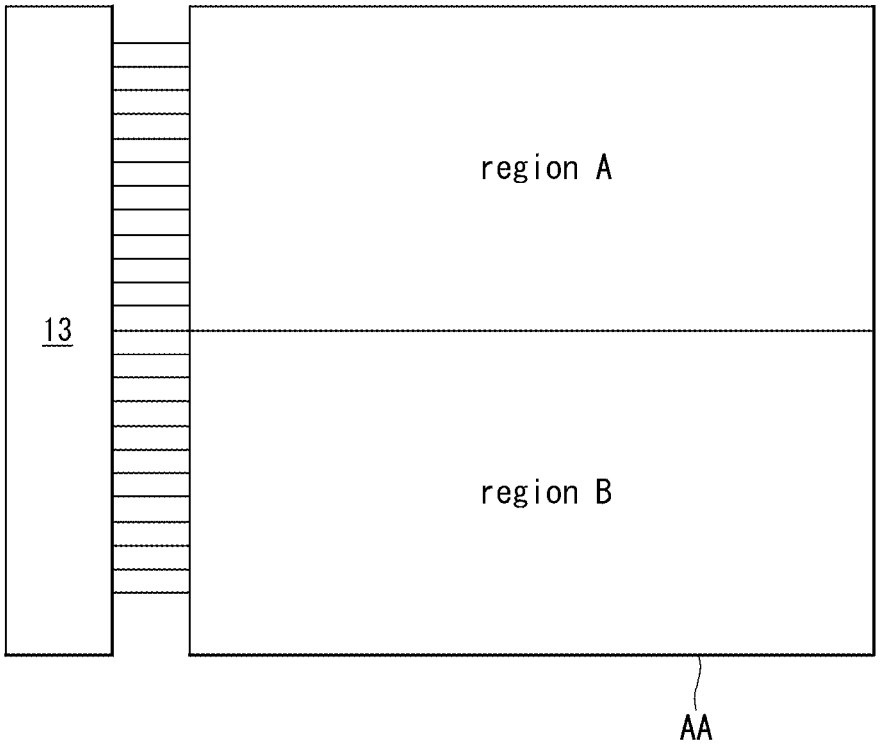
FIG. 10 is a view illustrating an example in which a pixel array is divided into region A and region B on the basis of phase-separated clock group A and clock group B so as to be driven.
Figure 11:
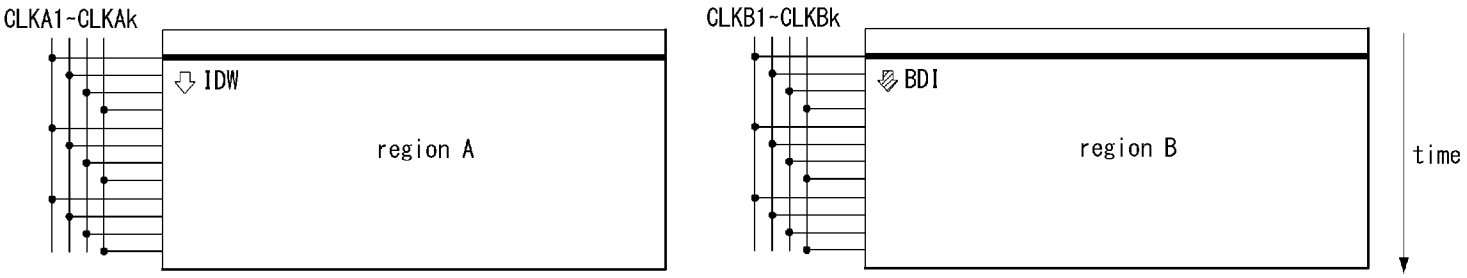
FIG. 11 is a view illustrating an operation of writing an image data voltage into region B according to clock group B, while writing a black image into region A according to clock group A.
Figure 12:
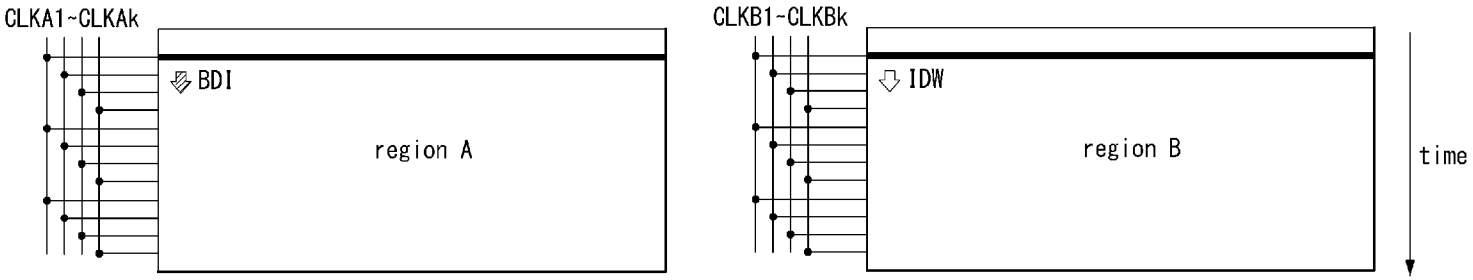
FIG. 12 is a view illustrating an operation of writing a black image into region B according to clock group B, while writing an image data voltage into region A according to clock group A.

FIGS. 10 to 12 are views illustrating an example in which a pixel array is divided into region A and region B on the basis of phase-separated clock group A and clock group B so as to be driven in a division manner.

As illustrated in FIG. 6, since two pixel lines are driven in an overlapping manner, a data collision (or data intermingling) may occur. In order to prevent such a data collision, in the display device of this disclosure, gate shift clocks may be separated into clock group A CLKA1 to CLKAk and clock group B CLKB1 to CLKBk and a pixel array may be divided into one region A of an upper portion of a screen and one region B of a lower portion of the screen on the basis of the clock group A LKA1 to CLKAk and the clock group B CLKB1 to CLKBk and driven in a division manner. In the shift register 500, the clock group A CLKA1 to CLKAk are input to stages for driving gate lines of the region A, and the clock group B CLKB1 to CLKBk are input to stages for driving gate lines of the region B. The stages for driving the gate lines of the region A output a gate signal for IDW driving according to a first pulse of the gate start signal and output a gate signal for BDI driving according to a second pulse of the gate start signal. The stages of the shift register 500 may be cascade-connected so that the pixel lines of the region A of the upper portion of the screen and the region B of the lower portion of the screen are sequentially driven. The uppermost pixel line of the region B is driven after the lowermost pixel line of the region A. The second pulse of the gate start signal is applied to the region B at a time point when IDW driving according to the first pulse of the gate start signal starts in the region B, and the first pulse of the gate start signal is applied to the region A at a time point when BDI driving according to the second pulse of the gate start pulse starts in the region B. In this manner, when IDW driving according to the first pulse is performed in the region A, BDI driving according to the second pulse is simultaneously performed in the region B, and conversely, when IDW driving according to the first pulse is performed in the region B, BDI driving according to the second pulse may be simultaneously performed in the region A.

As illustrated in FIG. 11, in the display device of the present disclosure, the region A may be IDW-driven according to the clock group A CLKA1 to CLKAk and the region B may be simultaneously BDI-driven according to the clock group B CLKB1 to CLKBk. In addition, as illustrated in FIG. 12, in the display device of the present disclosure, the region A may be BDI-driven according to the clock group A CLKA1 to CLKAk and the region B may be simultaneously IDW-driven according to the clock group B CLKB1 to CLKBk.

Since the phases of the clock group A CLKA1 to CLKAk and the clock group B CLKB1 to CLKBk are separated from each other, a write timing of the data voltage VIDW for IDW (or write timing of the data voltage VBDI for BDI) with respect to the first pixel line of the region A and a write timing of the data voltage VBDI for BDI (or write timing of the data voltage VIDW for IDW) with respect to the second pixel line of the region B do not temporally overlap and the data voltages VBDI and VIDW are not intermingled. However, when the pixel array is divided into the two upper and lower regions A and B and driven in the division manner, the emission duty ratio of 50% may be implemented.

Figure 13:
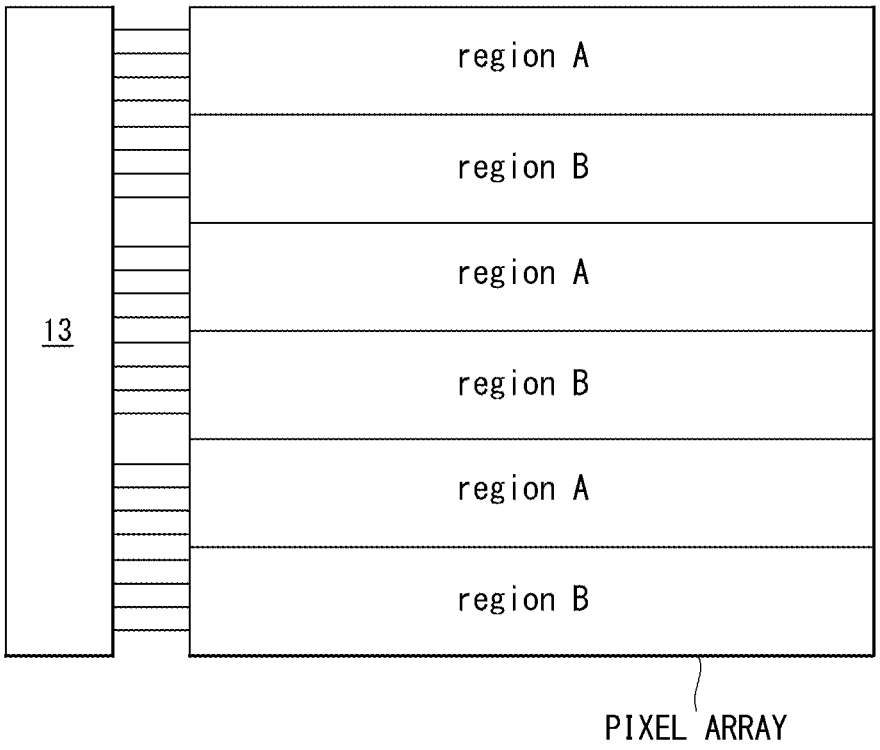
FIG. 13 is a view illustrating an example in which a pixel array is divided into a plurality of regions A and a plurality of regions B on the basis of phase-separated clock group A and clock group B so as to be driven.
Figure 14:
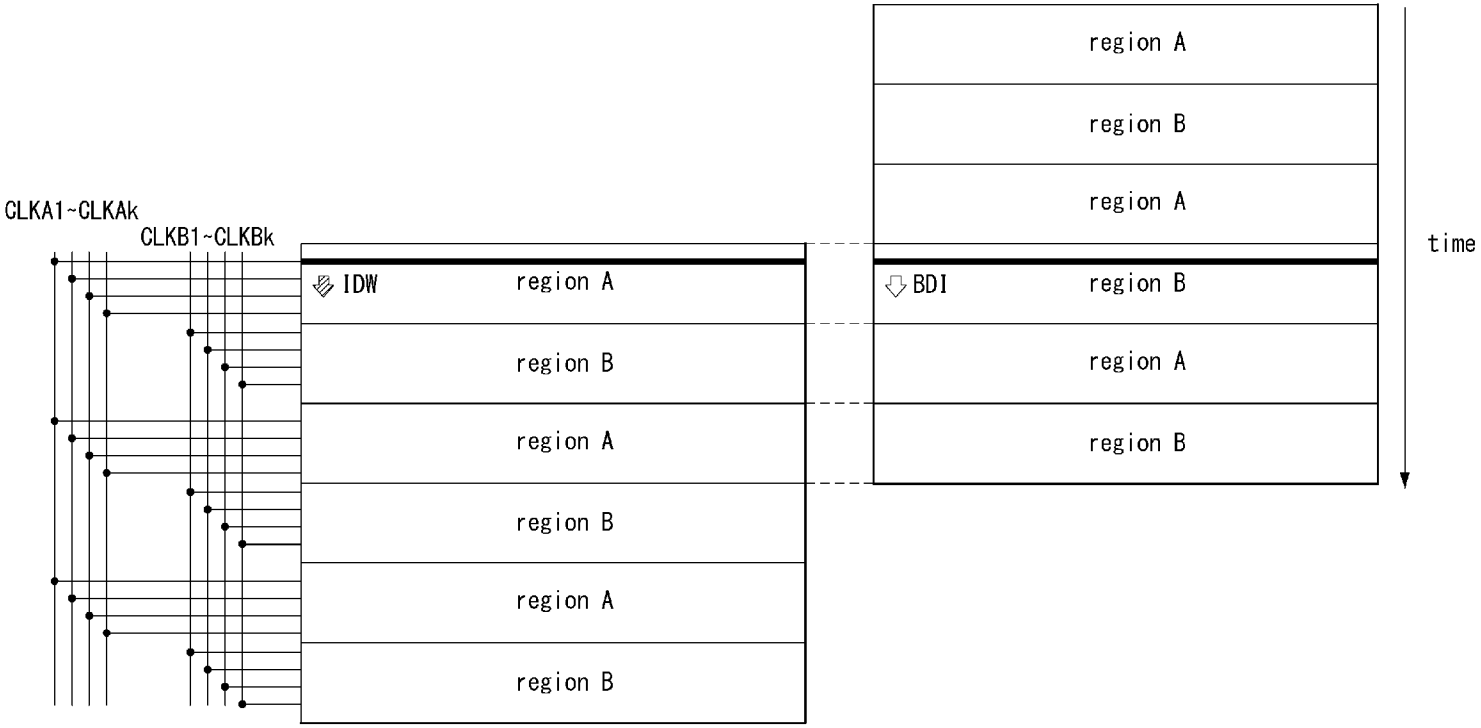
FIG. 14 is a view illustrating sequentially writing black data into areas A1-B1-A2-B2-A3-B3 and sequentially writing image data into areas B2-A3-B3-A1-B1-A2 according to clock group A and clock group B.

FIGS. 13 and 14 are views illustrating an example in which a pixel array is divided into a plurality of regions A and a plurality of regions B and driven in the division manner on the basis of phase-separated clock group A and clock group B. The plurality of regions A and the plurality of regions B may be alternately arranged, and when the pixel array is divided into the regions A and the regions B on the basis of the arrangement, design freedom for adjusting the emission duty ratio may be increased.

In the shift register 500, the clock group A CLKA1 to CLKAk are input to the stages for driving the gate lines of the regions A, and the clock group B CLKB1 to CLKBk are input to the stages for driving the gate lines of the regions B. The stages are cascade-connected so that the pixel lines may be sequentially driven at all the boundaries of the regions A and the regions B.

In FIG. 14, a write timing of the data voltage VIDW for IDW is sequentially shifted from the top region A of the pixel array according to the clock group A CLKA1 to CLKAk and the first pulse of the gate start signal, and at the same time, a write timing of the data voltage VBDI for BDI is sequentially shifted from a middle region B of the pixel array according to the clock group B CLKB1 to CLKBk and the second pulse of the gate start signal. When the second pulse of the gate start signal is applied at a time point when IDW driving according to the first pulse of the gate start signal enters a certain region B, driving may be performed as mentioned above. Also, when the first pulse of the gate start signal is applied at a time point when BDI driving according to the second pulse of the gate start signal enters a certain region B, driving may be performed as mentioned above.

Figure 15:
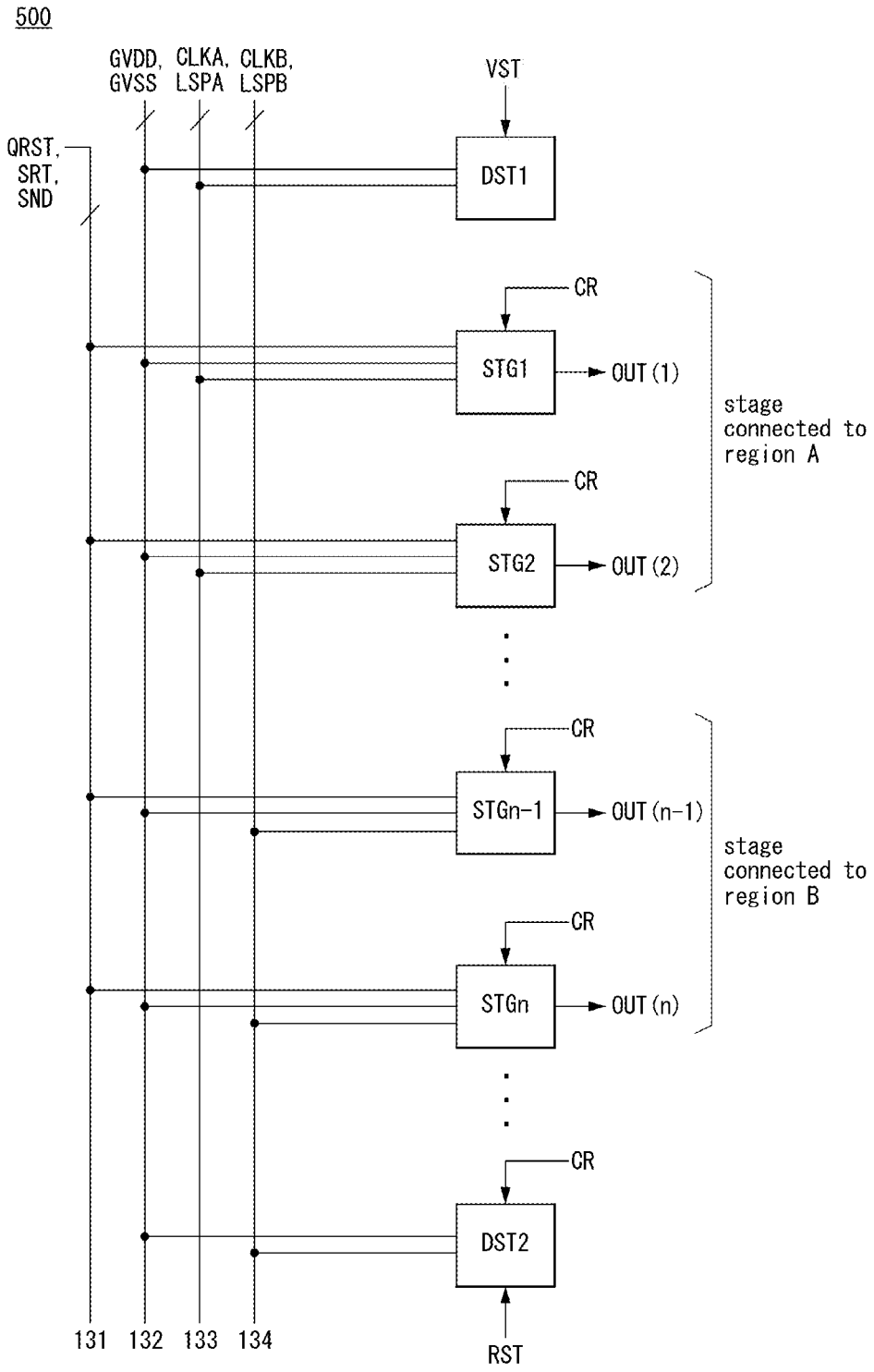
FIG. 15 is a view illustrating a configuration of a shift register.
Figure 16:
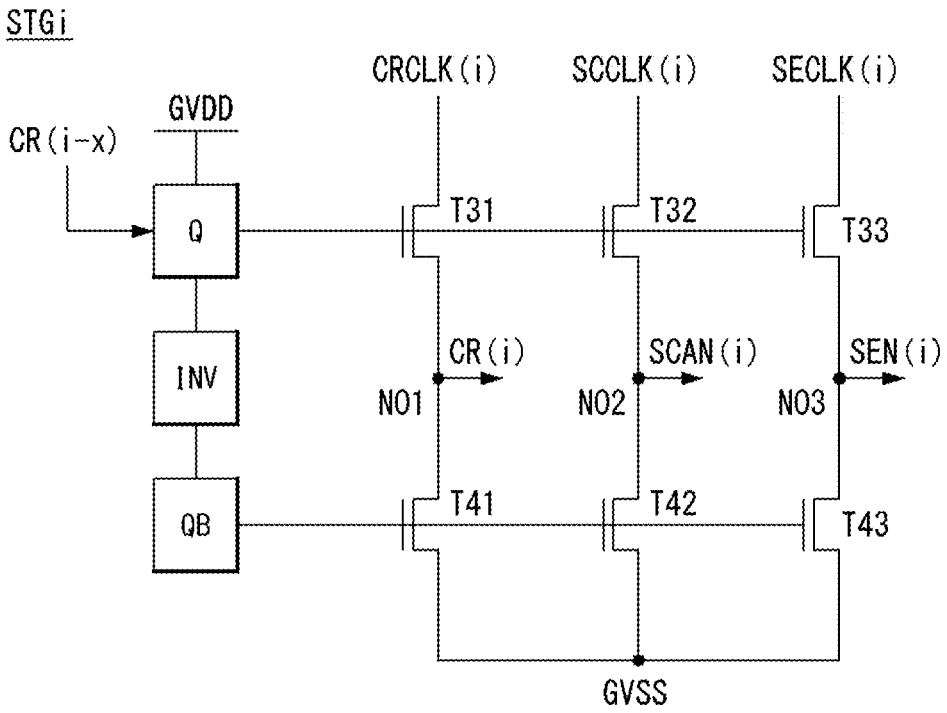
FIG. 16 is a view schematically illustrating a stage in a shift register.

FIG. 15 is a view illustrating a connection configuration of stages included in the gate driver of FIG. 1. FIG. 16 is a view schematically illustrating a stage of FIG. 15.

Referring to FIG. 15, the shift register 500 includes a plurality of stages STG1 to STGn connected in cascade, and the stages STG to STGn are connected to the gate lines of the pixel array, respectively. The stages STG1 to STGn are activated according to a carry signal CR input from a front stage to sequentially output the gate signal. The gate signal includes a scan signal, a sense signal, and a carry signal. The "front stage" refers to a stage which is activated earlier than a reference stage and generates a gate signal whose phase is earlier than a gate signal output from the reference stage.

The stages STG1 to STGn may be simultaneously reset by a global initialization signal QRST input when the display device is powered on. A sensing start timing instruction signal SRT, a sensing end timing instruction signal SND, a high potential power supply voltage GVDD, and a low potential power supply voltage GVSS may be commonly input to the stages STG1 to STGn.

Referring to FIG. 16, i-th stage STGi includes first to third pull-up transistors T31, T32, and T33 outputting clock signals CRCLK, SCCLK, and SECLK as gate signals according to a voltage of a node Q and first to third pull-down transistors T41, T42, and T43 discharging output terminals NO1, NO2 and NO3 to a low potential power supply voltage GVSS according to a voltage of a node QB. The i-th stage STGi is a stage outputting a gate signal for driving i-th pixel line of the pixel array. The node Q may be charged upon receiving a front stage carry signal CR(i−x) and discharged upon receiving a global initialization signal QRST or a rear stage carry signal. The node QB may be charged and discharged by an inverter INV in a manner opposite to that of the node Q. As described above, the gate shift register of this disclosure simultaneously drives the plurality of pull-up transistors with the voltage of the node Q and simultaneously drives the plurality of pull-down transistors with the voltage of the node QB, and thus, the stage configuration may be simplified.

The first pull-up transistor T31 includes a gate electrode connected to the node Q, a first electrode receiving the carry clock signal CRCLK, and a second electrode connected to the first output terminal NO1. The first pull-up transistor T31 outputs a carry signal CR(i) by applying the carry clock signal CRCLK to the first output terminal n1 while the node Q is being charged.

The second pull-up transistor T32 includes a gate electrode connected to the node Q, a first electrode receiving the scan clock SCCLK, and a second electrode connected to the second output terminal NO2. The second pull-up transistor T32 outputs a scan signal SCAN(i) by applying the scan clock SCCLK to the second output terminal NO2 while the node Q is being charged.

The third pull-up transistor T33 includes a gate electrode connected to the node Q, a first electrode receiving the sense clock SECLK, and a second electrode connected to the third output terminal NO3. The third pull-up transistor T33 outputs a sense signal SEN(i) by applying the sense clock SECLK to the third output terminal NO3, while the node Q is being charged.

The first pull-down transistor T41 includes a gate electrode connected to the node QB, a first electrode receiving the low potential power supply voltage GVSS, and a second electrode connected to the first output node NO1. The first pull-down transistor T41, in response to a node QB voltage, discharges the first output terminal NO1 to the low potential power supply voltage GVSS.

The second pull-down transistor T42 includes a gate electrode connected to the node QB, a first electrode receiving the low potential power supply voltage GVSS, and a second electrode connected to the second output node NO2. The second pull-down transistor T42, in response to the node QB voltage, discharges the second output terminal NO2 to the low potential power supply voltage GVSS.

The third pull-down transistor T43 includes a gate electrode connected to the node QB, a first electrode receiving the low potential power supply voltage GVSS, and a second electrode connected to the third output node NO3. The third pull-down transistor T43, in response to the node QB voltage, discharges the third output terminal NO3 to the low potential power supply voltage GVSS.

The inverter INV controls the voltages of the node Q and the node QB to be inverse.

Figure 18:
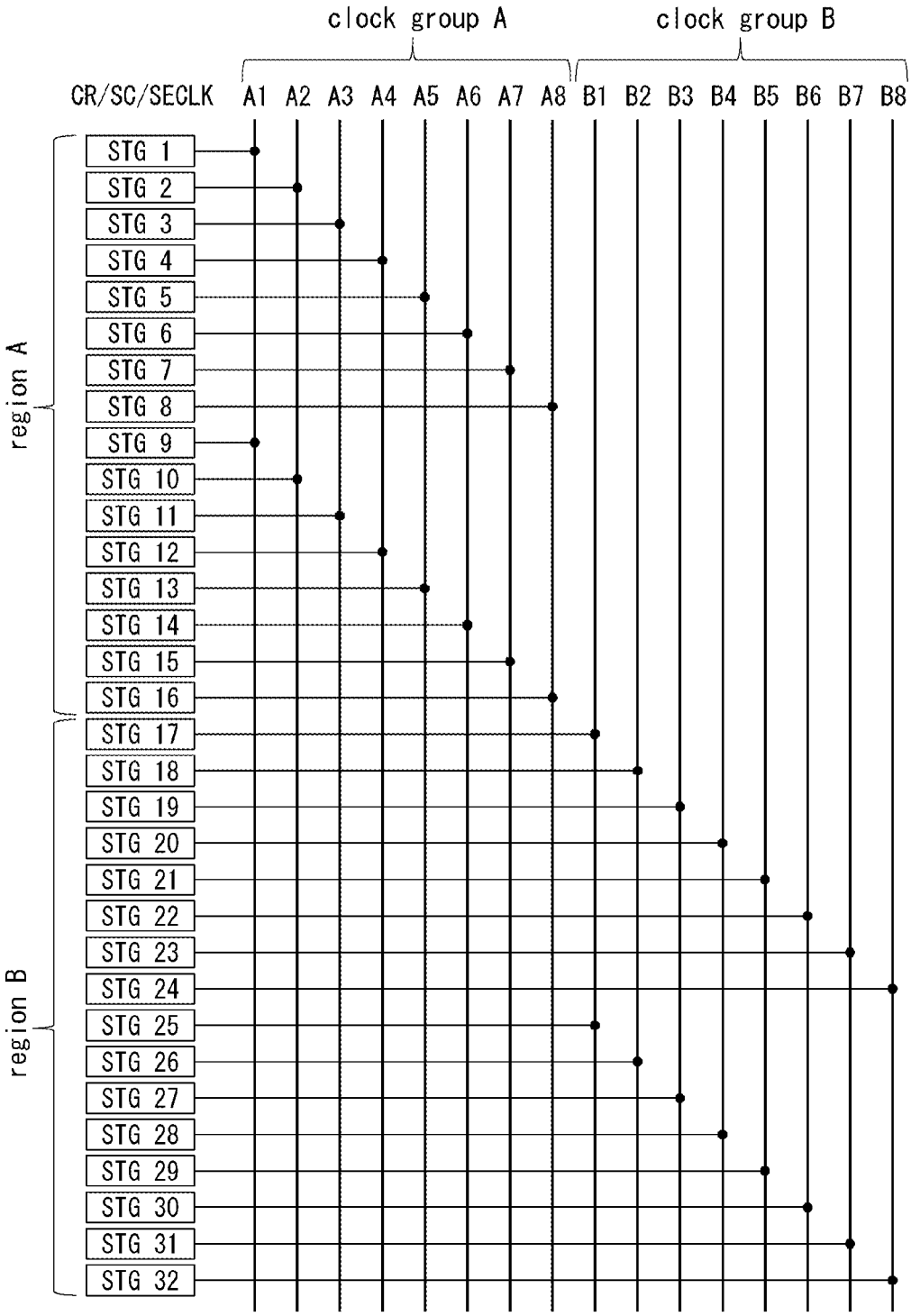

FIGS. 17 and 18 are views illustrating a connection relationship between gate clocks and a shift register according to an embodiment.

Referring to FIGS. 17 and 18, the timing controller 200 sets, to 32, the number of phase shifts per clock cycle of each of the carry clock CRCLK, the scan clock SCCLK, and the sense clock SECLK. The timing controller 200 separates the carry clock CRCLK, the scan clock SCCLK, and the sense clock SECLK into clock group A A1 to A8, A1 to A8 and clock group B B1 to B8 and B1 to B8. The carry clock CRCLK, the scan clock SCCLK, and the sense clock SECLK of the clock group A A1 to A8, A1 to A8 are connected to first to sixteenth stages STG1 to STG16. The carry clock CRCLK, the scan clock SCCLK, and the sense clock SECLK of the clock group B B1 to B8, B1 to B8 are connected to 17th to 32th stages STG17 to STG32.

As a result, a time difference between the start timing of IDW driving for the region A (or the region B) and the start timing of BDI driving for the region B (or the region A) may be set to 32n+16 horizontal periods, the number of pixel lines driven per m clock cycles is 32m.

In one frame, the timing controller 200 sequentially shifts phases of IDW/SDW carry clocks of the clock group A A1 to A8 and A1 to A8 and the IDW/SDW carry clocks of the clock group B B1 to B8 and B1 to B8 within one clock cycle, sequentially shifts phases of the BDI carry clocks of the clock group A A1 to A8 and A1 to A8 and the BDI carry clocks of the clock group B B1 to B8 and B1 to B8 within one clock cycle, sequentially shifts the phases of the IDW/SDW scan clocks of the clock group A A1 to A8 and A1 to A8 and the IDW/SDW scan clocks of the clock group B B1 to B8 and B1 to B8 within one clock cycle, and sequentially shifts the phases of the IDW/SDW sense clocks of the clock group A A1 to A8 and A1 to A8 and the IDW/SDW sense clocks of the clock group B B1 to B8 and B1 to B8 within one clock cycle. Meanwhile, the timing controller 200 may output the BDI scan clocks of the clock group A A1 to A8 and A1 to A8 and the BDI scan clocks of the clock group B B1 to B8 and B1 to B8 within one clock cycle alternately twice such that the timing controller 200 may simultaneously output the BDI scan clocks in units of A1 to A8 and simultaneously output the BDI scan clocks in units of B1 to B8. Thus, in the technique of improving the MPRT performance, the black image data (BD) insertion period is reduced and the write time of the input image data (ID) may be sufficiently secured instead.

A specific embodiment of the clock signals will be described below.

Figure 19A:
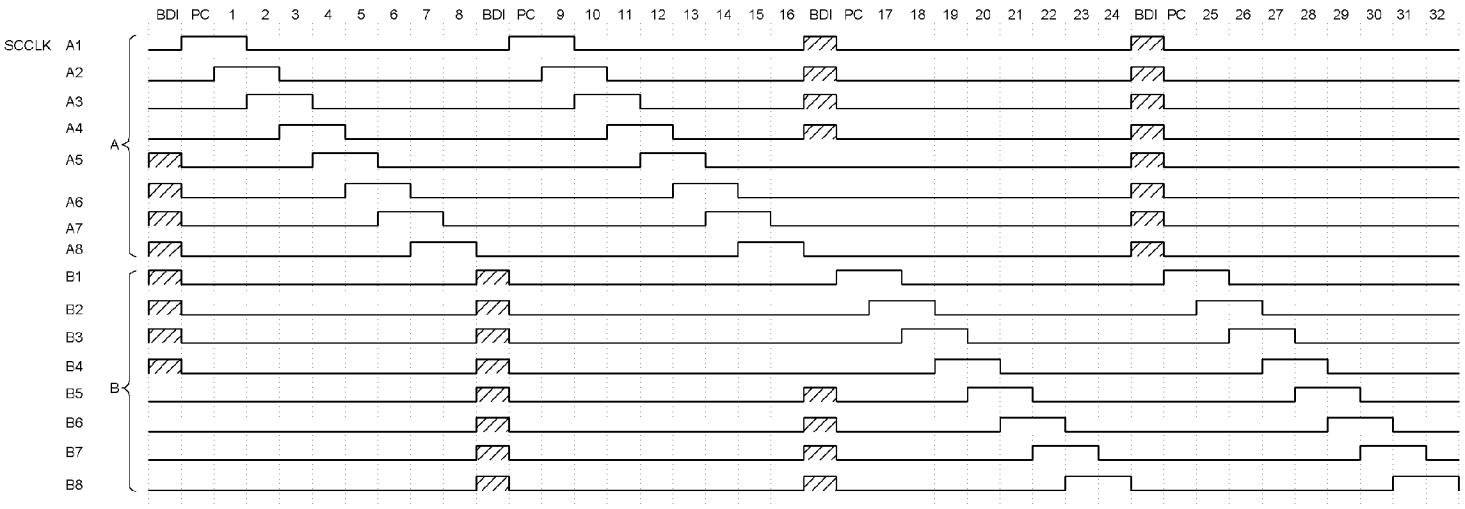
FIGS. 19A, 19B, 19C, 20A, 20B, 20C, 21A, 21B, 21C, 22A, 22B, 22C, 23A, 23B, 23C, 24A, 24B, 24C, 25A, 25B, 25C, 26A, 26B, and 26C illustrate scan clocks, sense clocks, and carry clocks belonging to first to eighth gate clock groups.
Figure 19B:
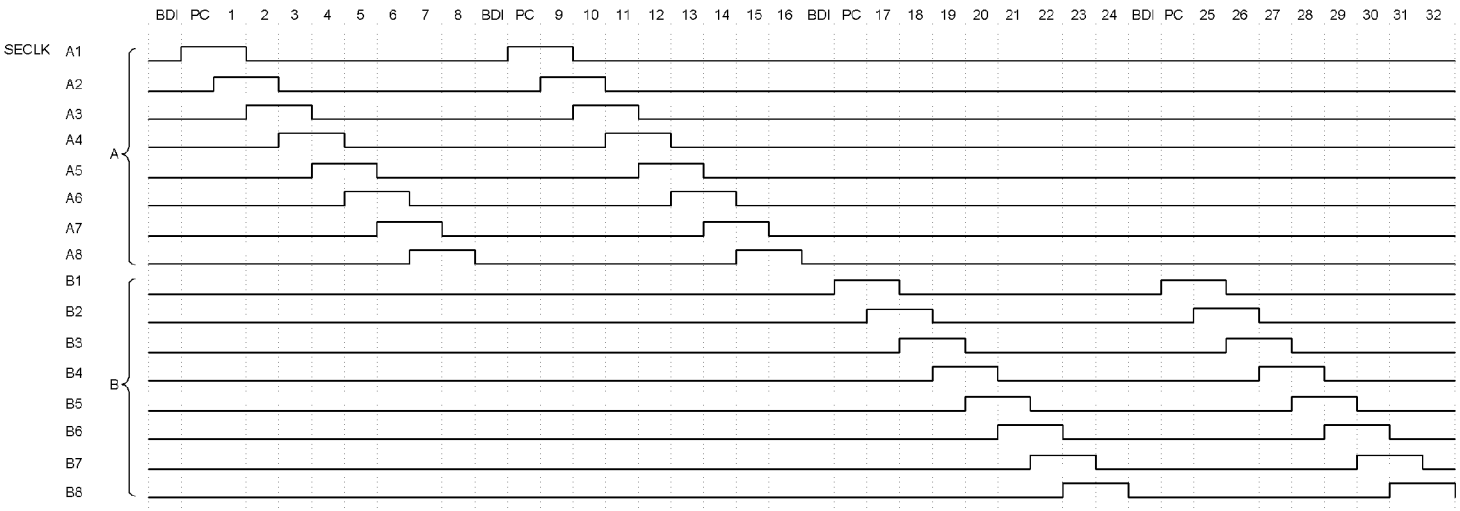
Figure 19C:
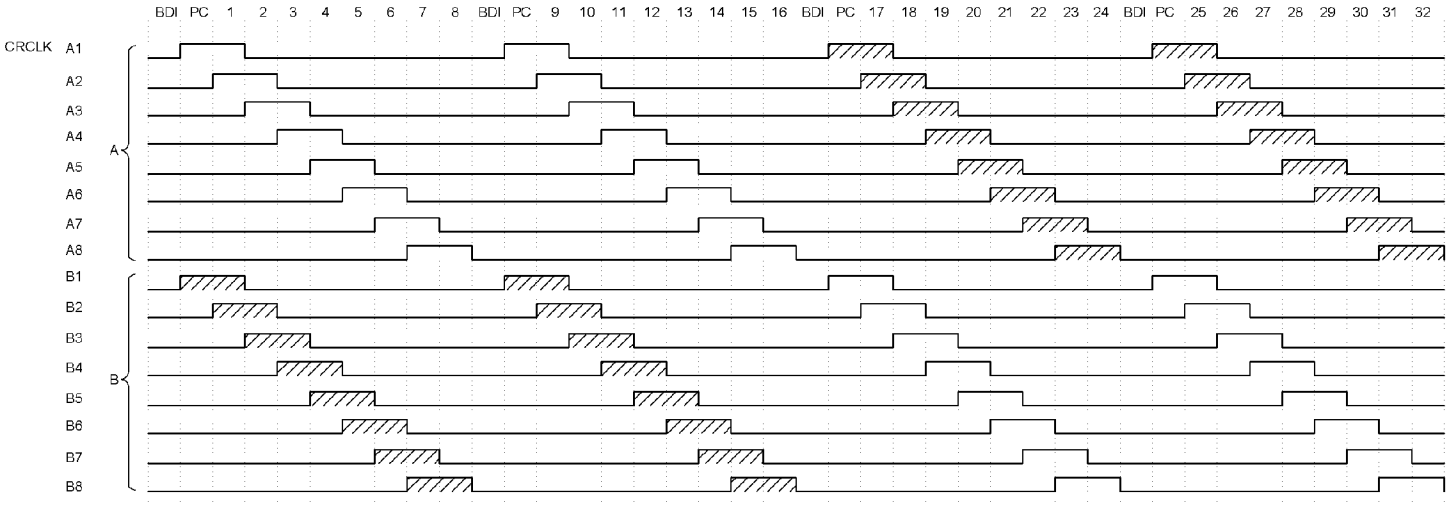
Figure 20A:
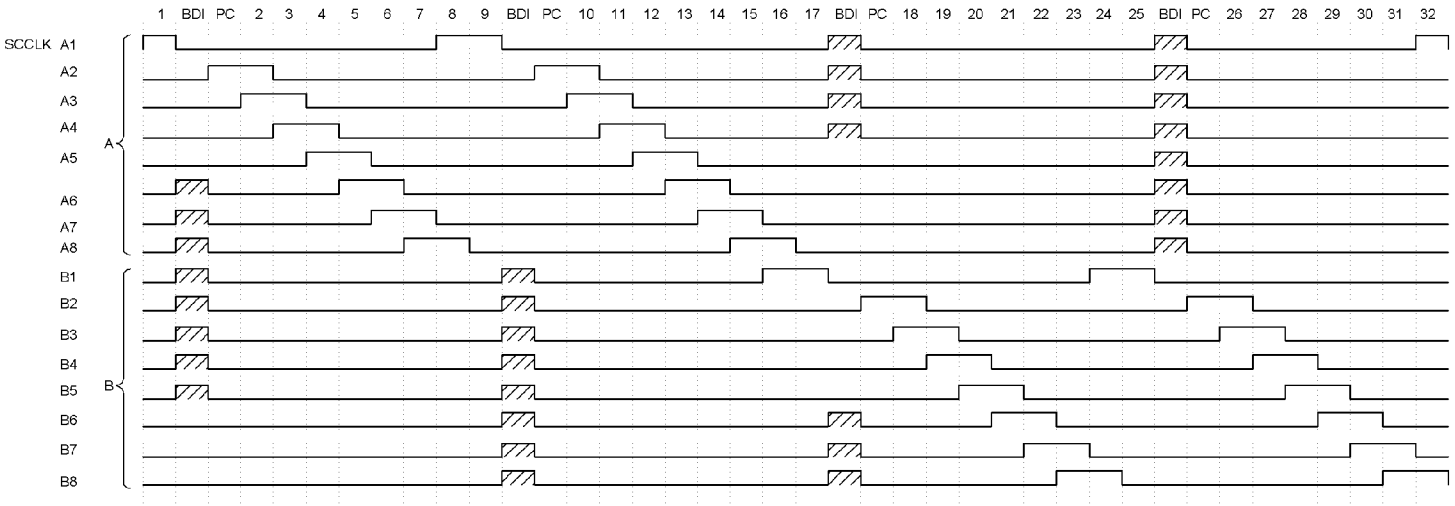
Figure 20B:
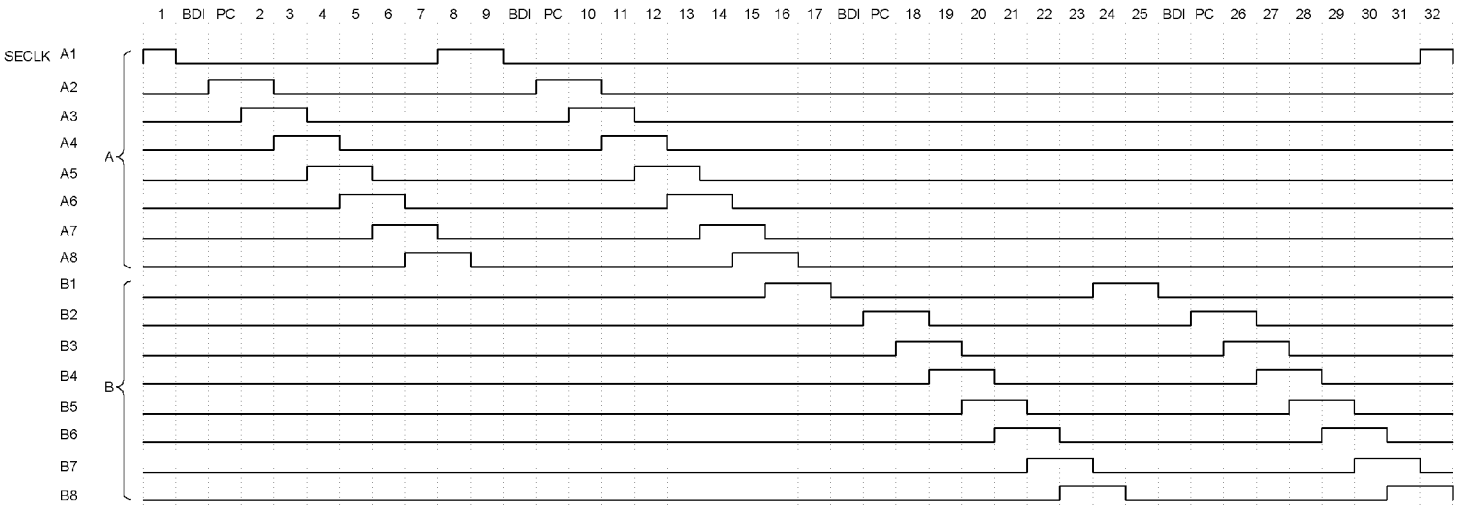
Figure 20C:
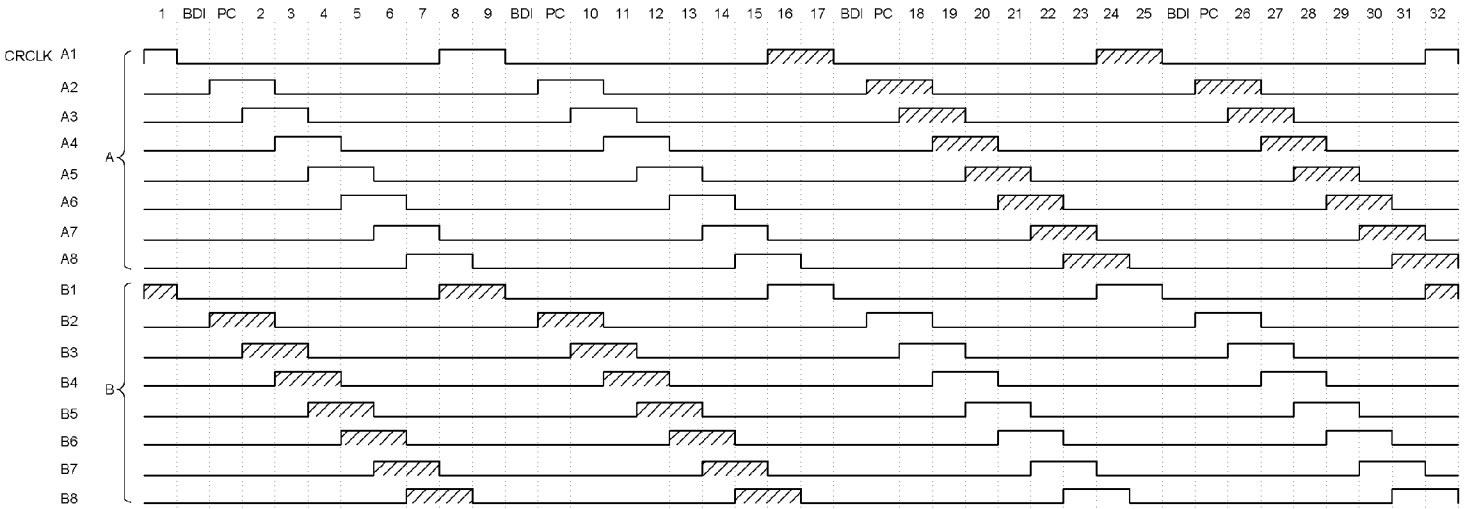
Figure 21A:
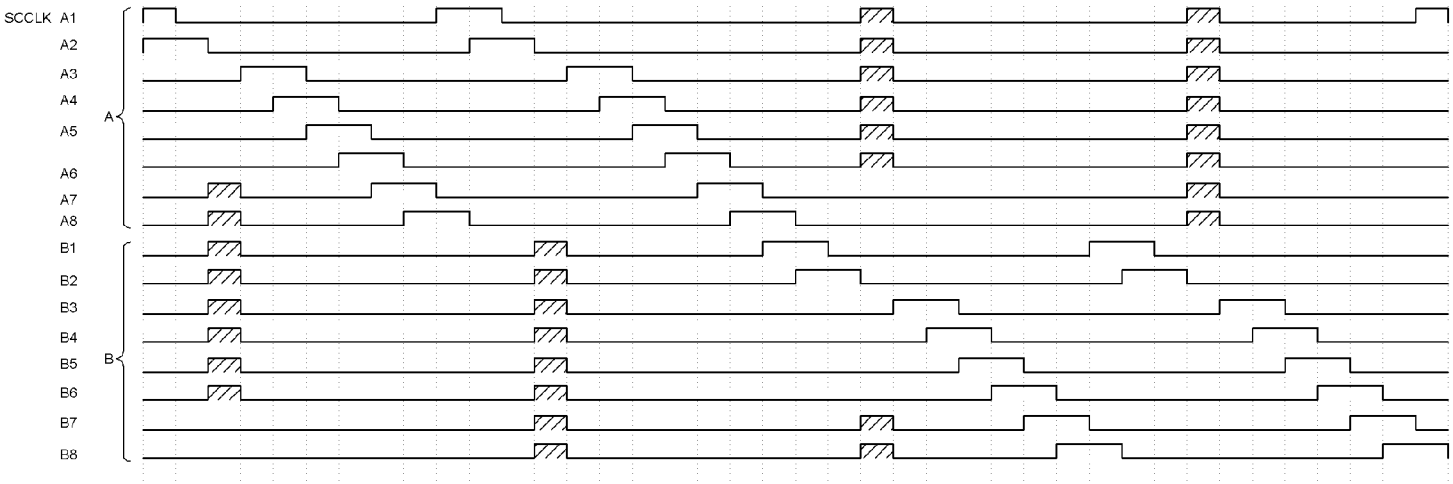
Figure 21B:
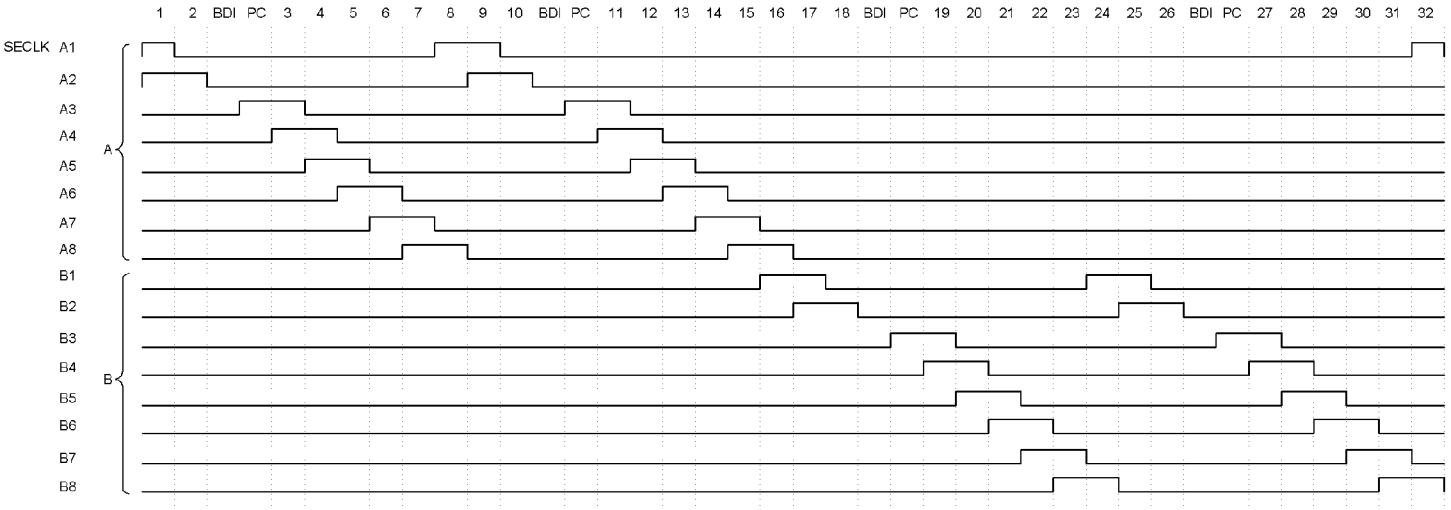
Figure 21C:
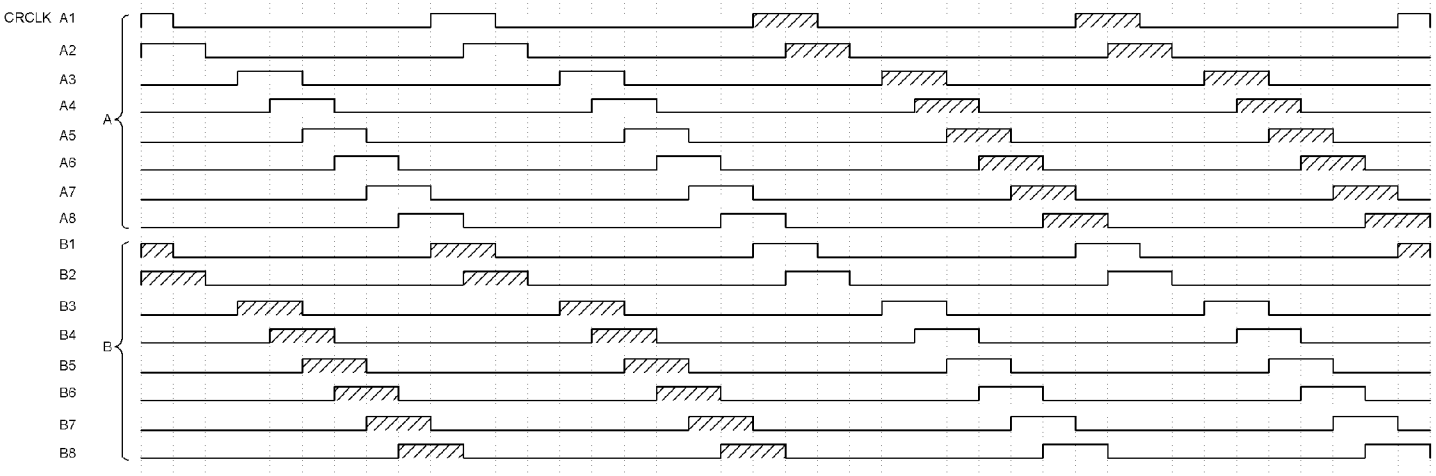
Figure 22A:
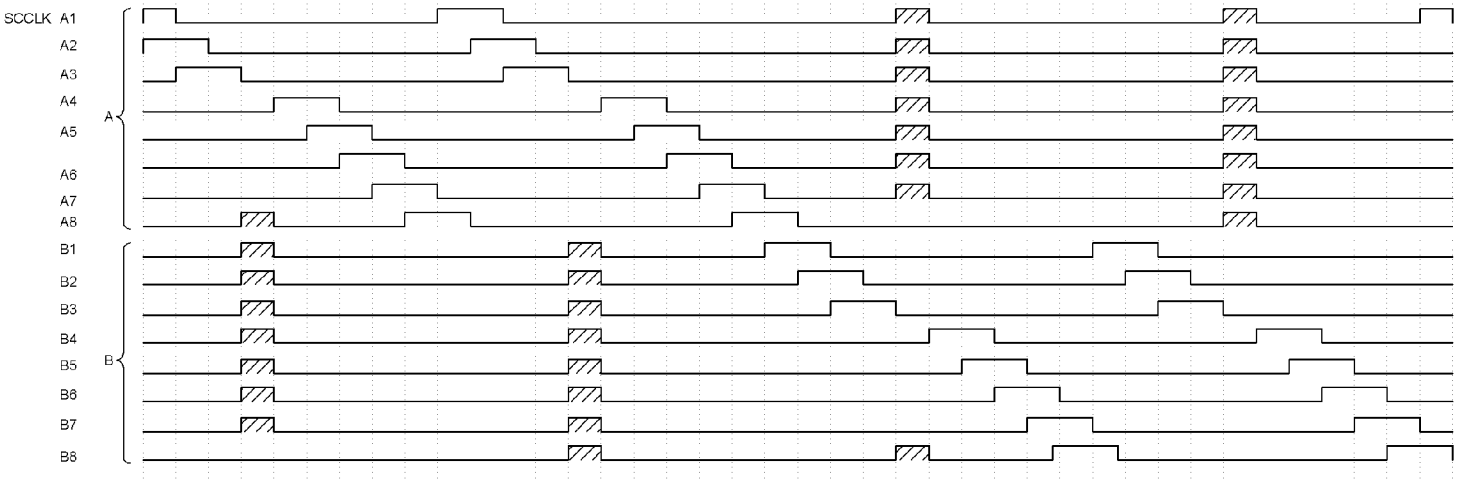
Figure 22B:
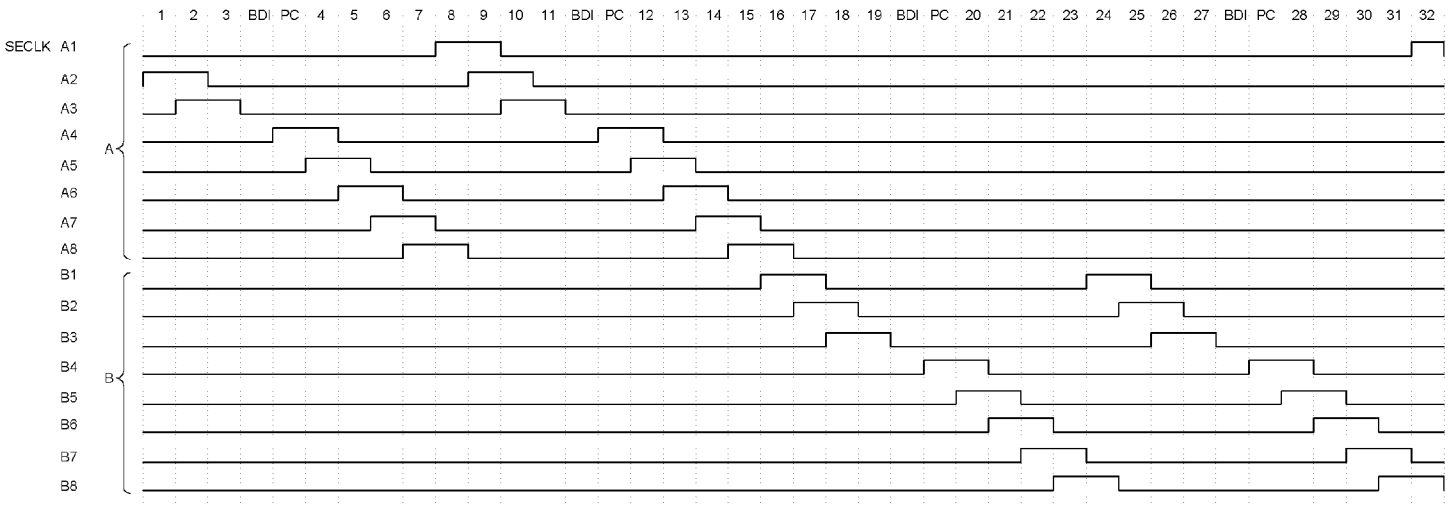
Figure 22C:
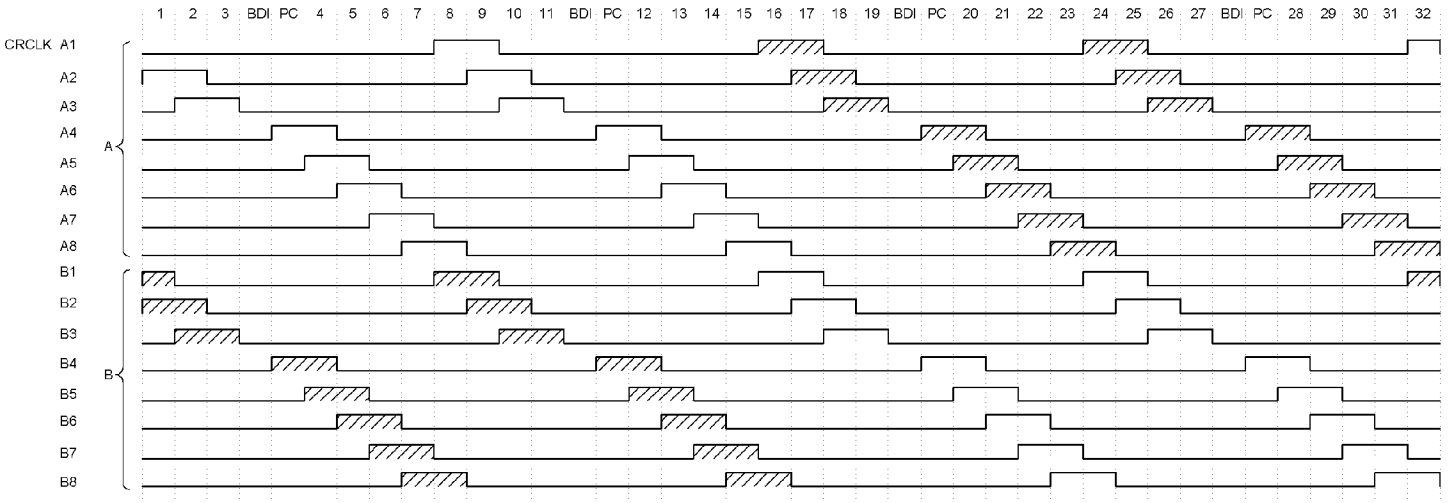
Figure 23A:
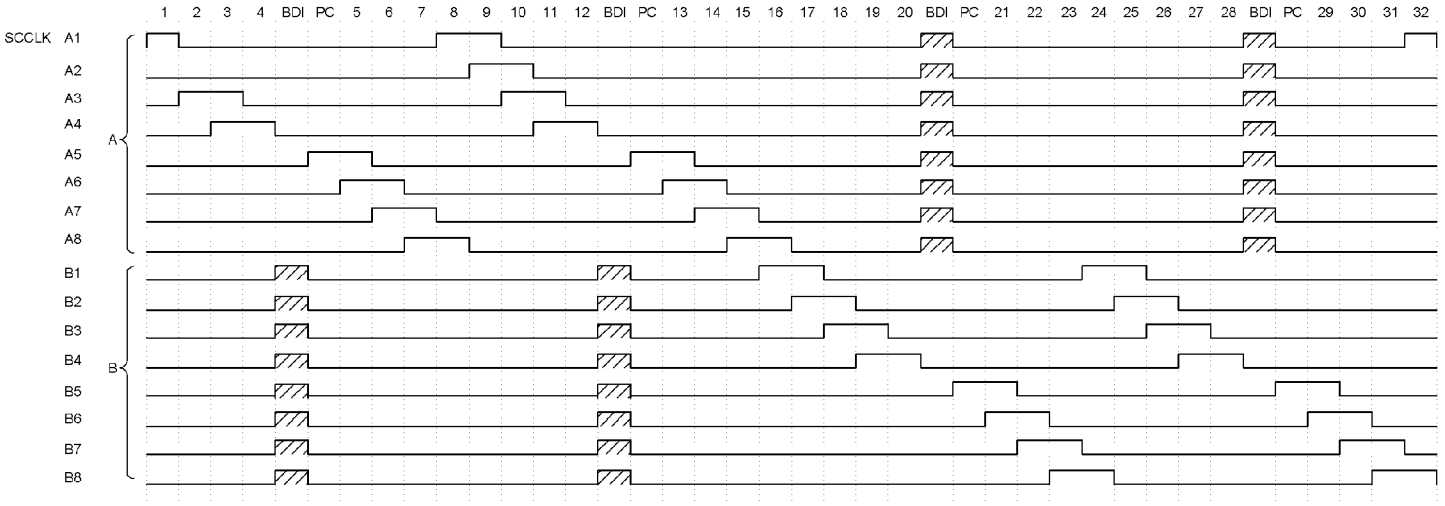
Figure 23B:
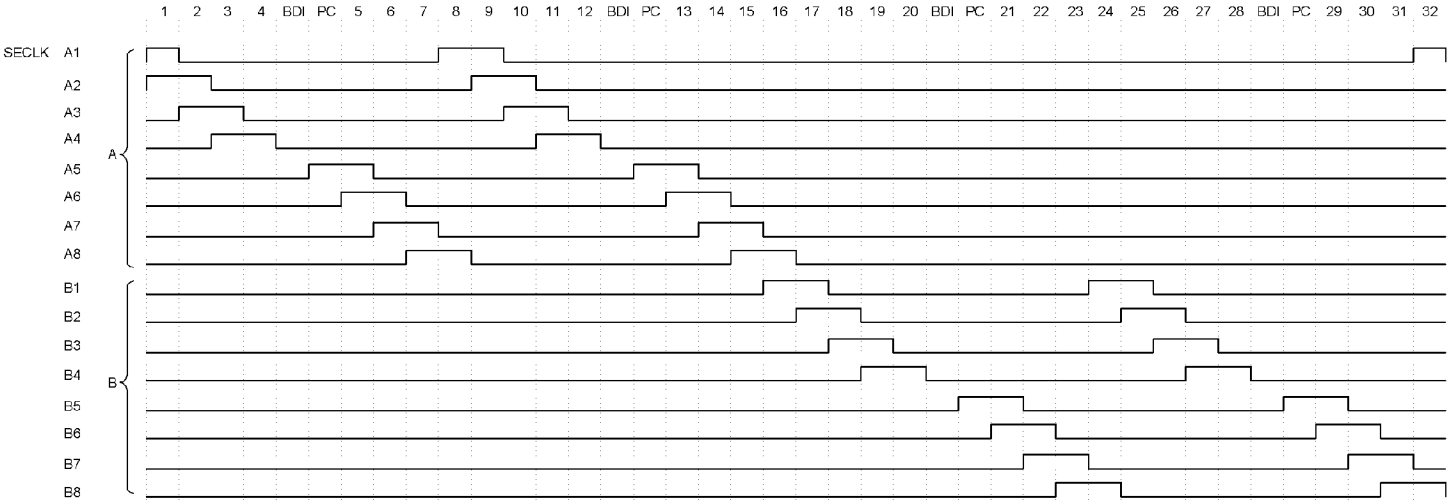
Figure 23C:
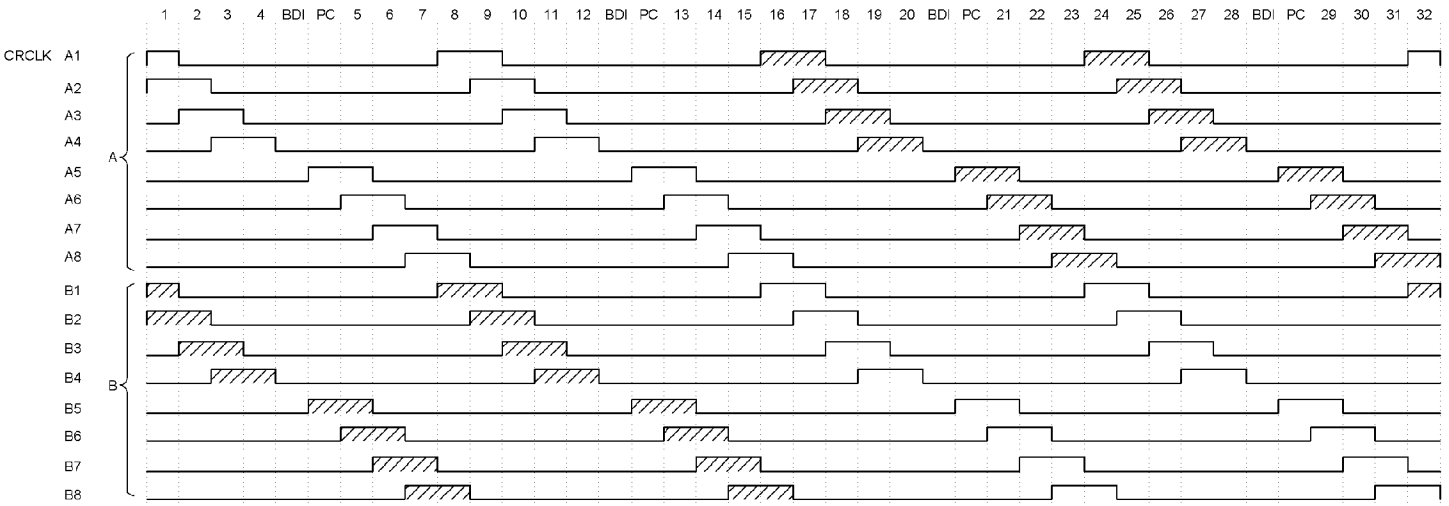
Figure 24A:
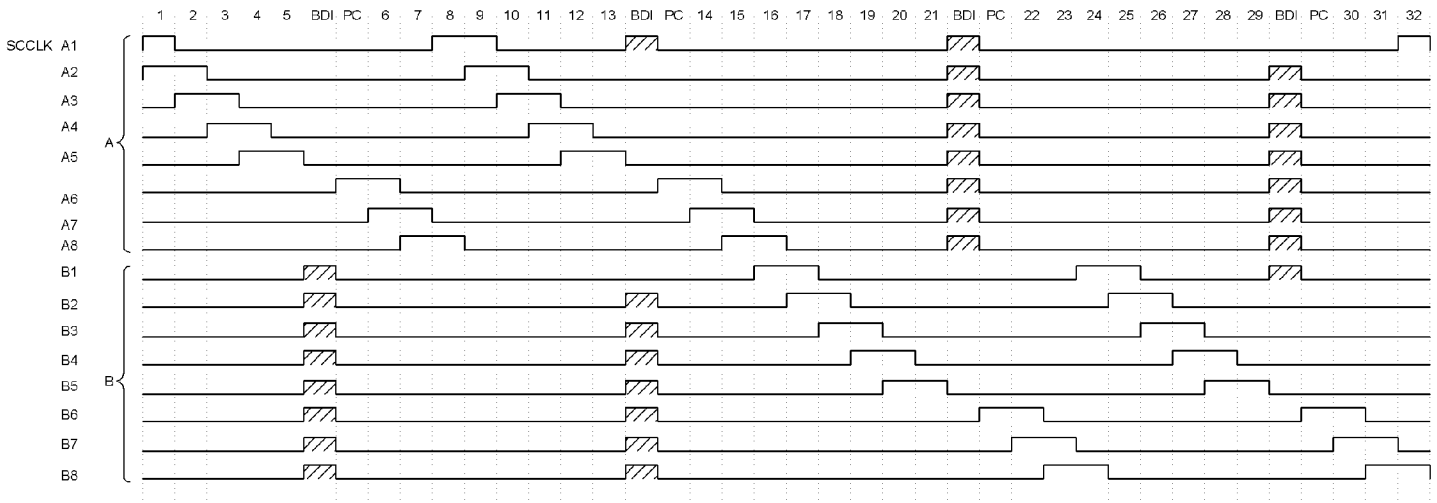
Figure 24B:
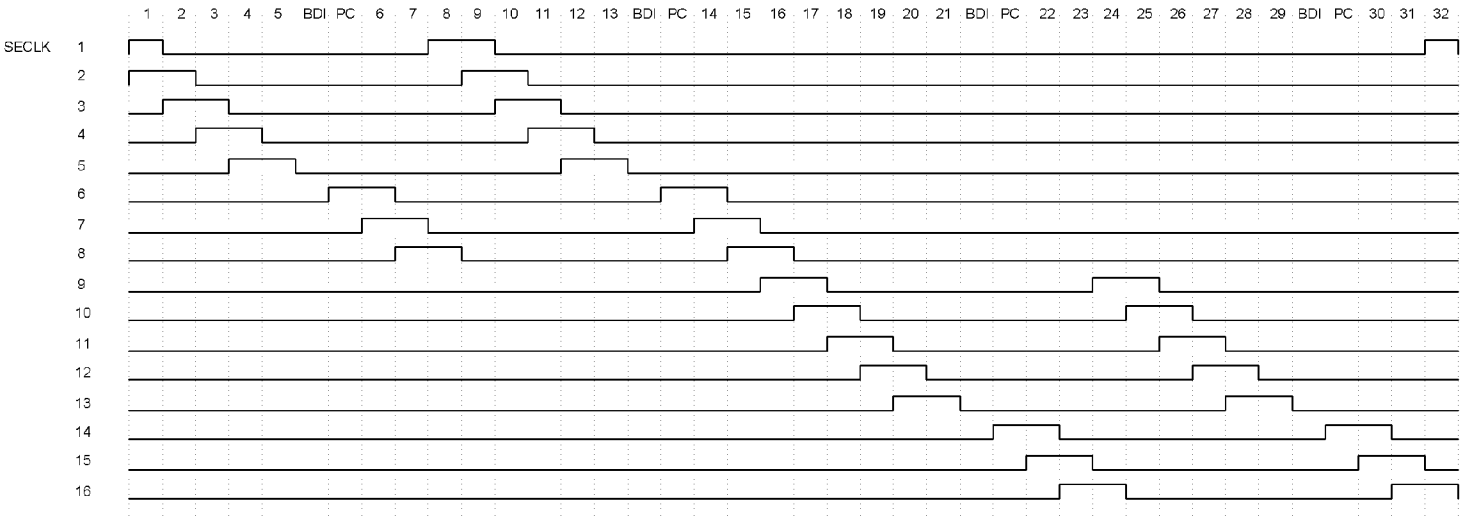
Figure 24C:
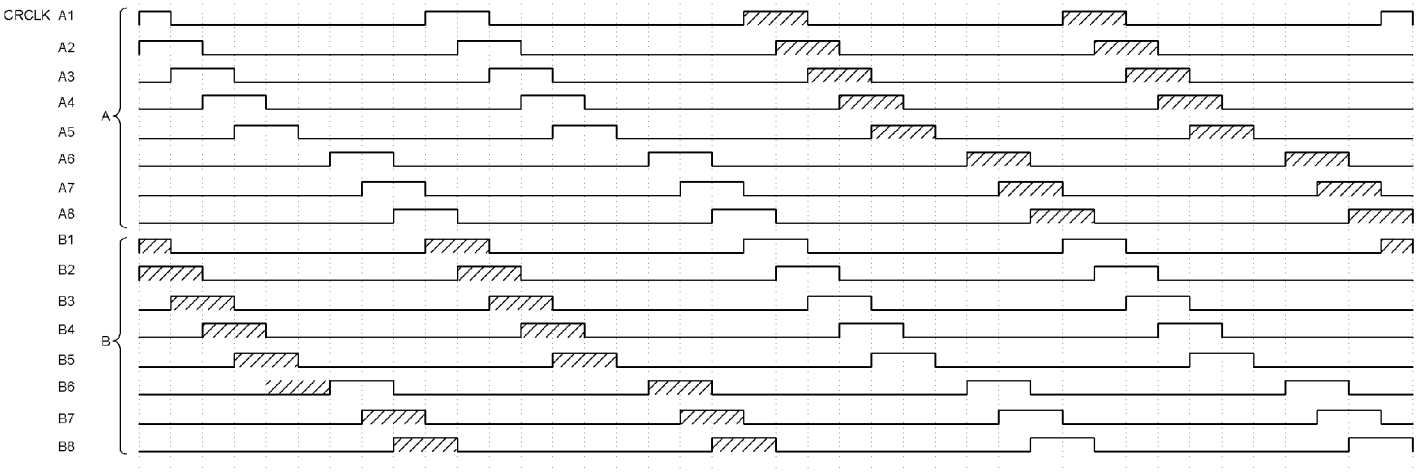
Figure 25A:
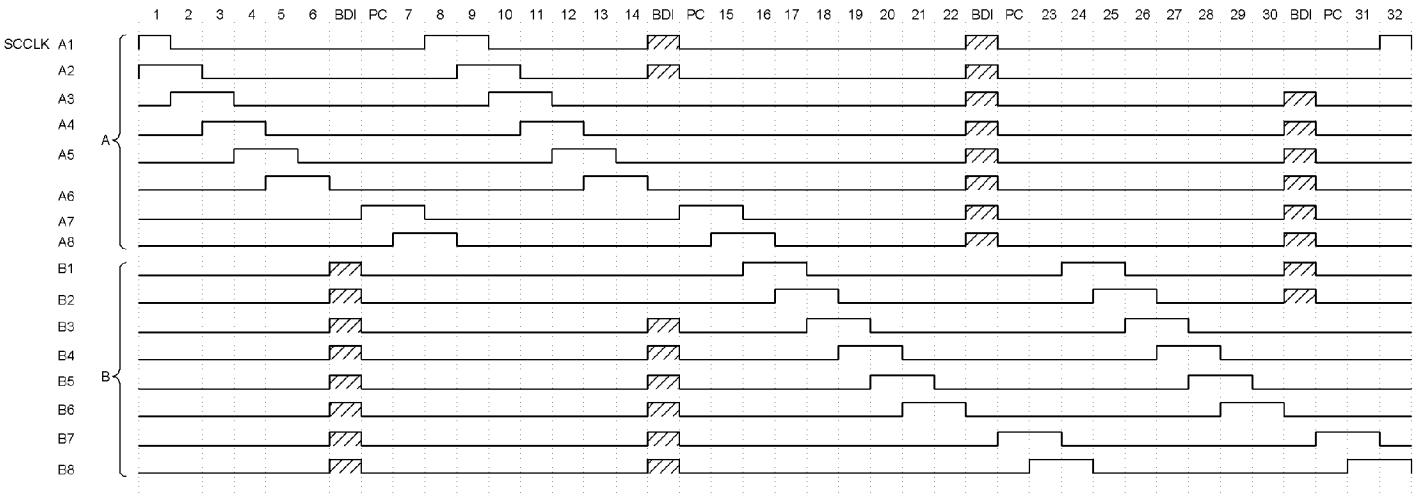
Figure 25B:
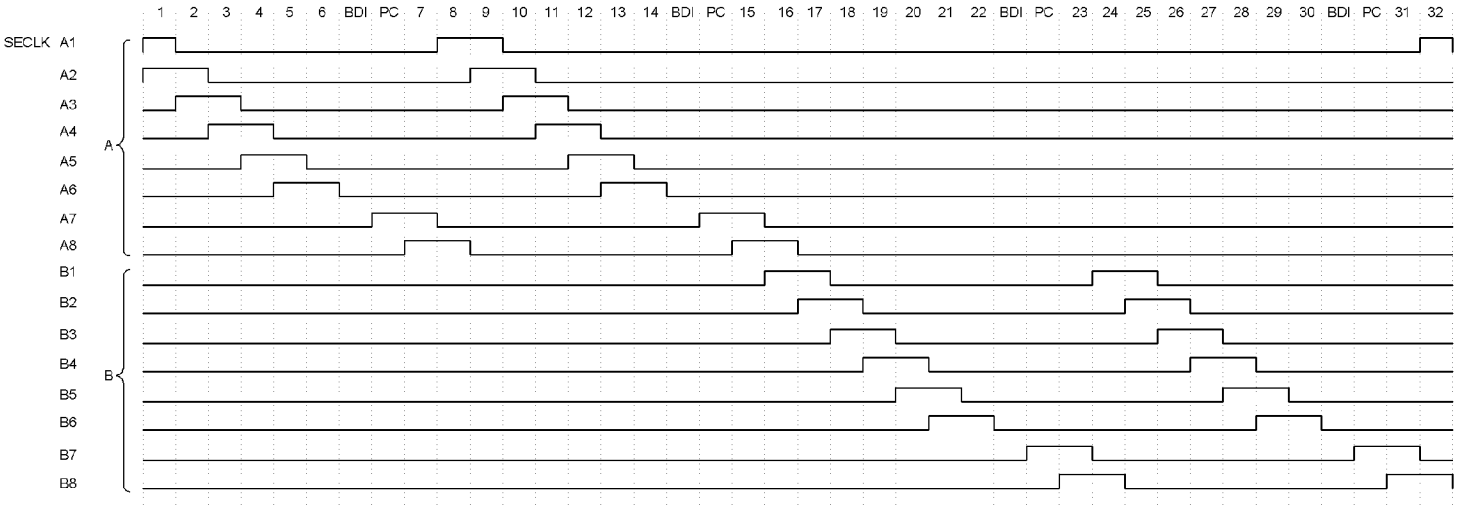
Figure 25C:
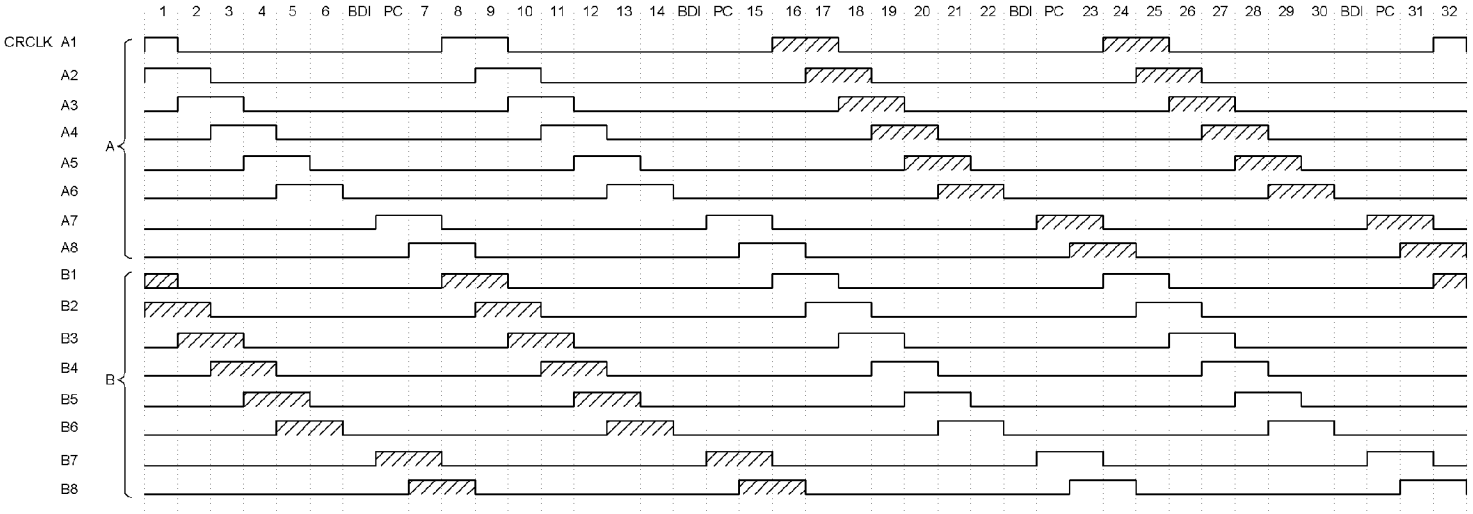
Figure 26A:
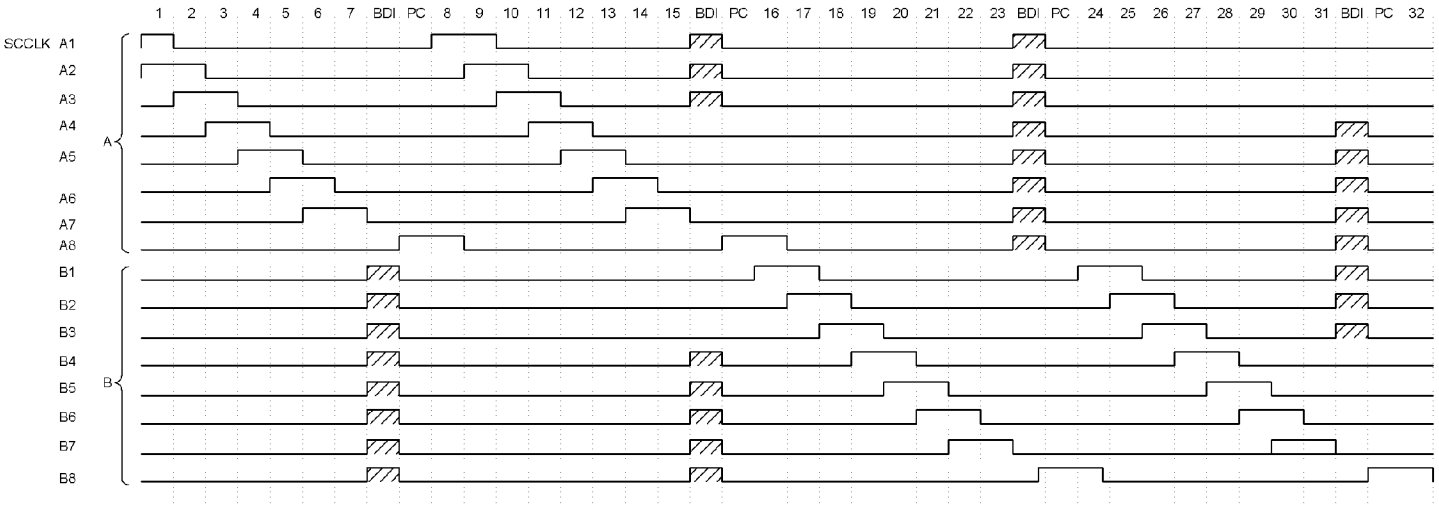
Figure 26B:
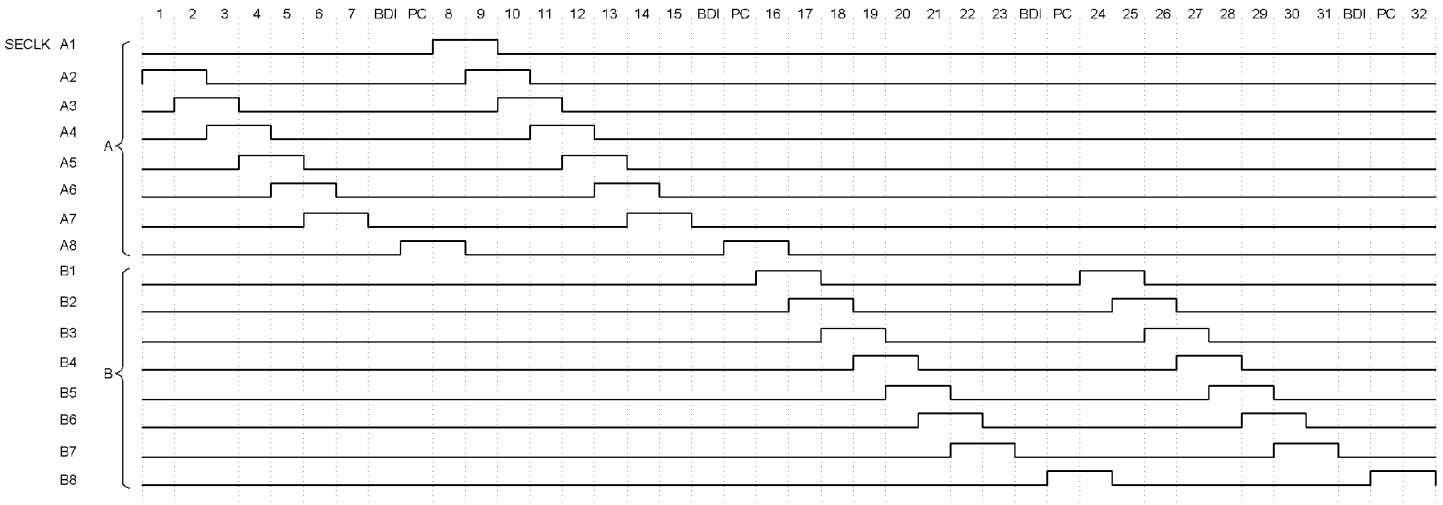
Figure 26C:
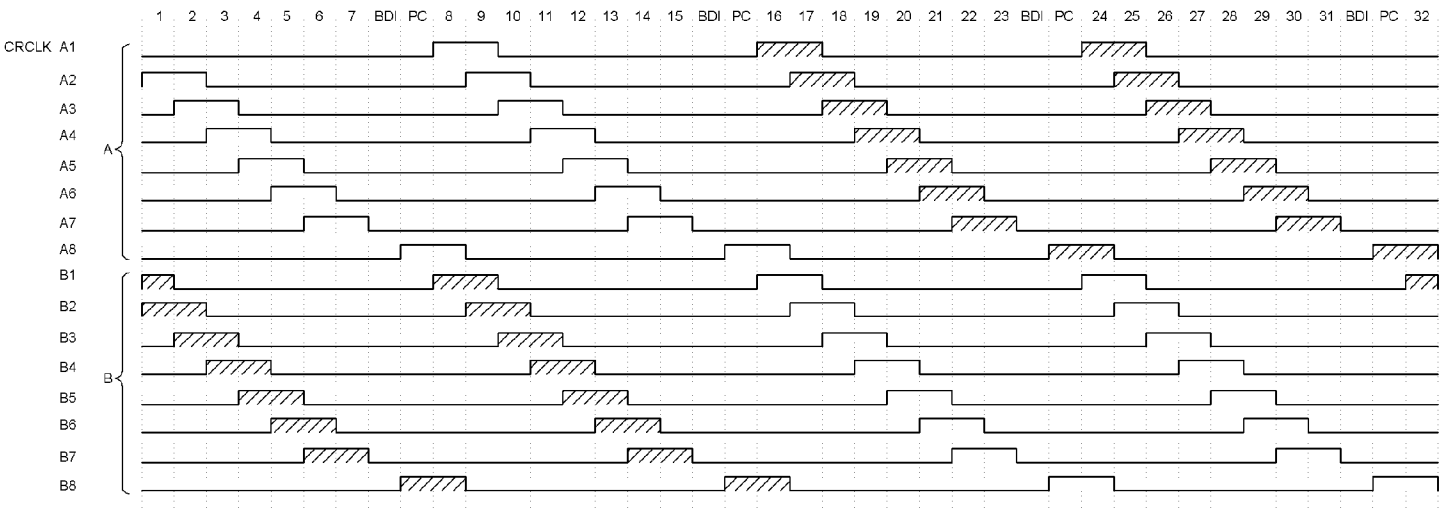

FIGS. 19A, 19B, 19C, 20A, 20B, 20C, 21A, 21B, 21C, 22A, 22B, 22C, 23A, 23B, 23C, 24A, 24B, 24C, 25A, 25B, 25C, 26A, 26B, and 26C are views illustrating first to eighth clock signal groups. FIGS. 19A, 19B and 19C are views illustrating a scan clock, a sense clock, and a carry clock of a first clock signal group GCLK1, respectively. FIGS. 20A, 20B, and 20C are views illustrating a scan clock, a sense clock, and a carry clock of a second clock signal group GCLK2, respectively. FIGS. 21A, 21B, and 21C are views illustrating a scan clock, a sense clock, and a carry clock of a third clock signal group GCLK3, respectively. FIGS. 22A, 22B, and 22C are views illustrating a scan clock, a sense clock, and a carry clock of a fourth clock signal group GCLK4. FIGS. 23A, 23B, and 23C are views illustrating a scan clock, a sense clock, and a carry clock of a fifth clock signal group GCLK5, respectively. FIGS. 24A, 24B and 24C are views illustrating a scan clock, a sense clock, and a carry clock of a sixth clock signal group GCLK6, respectively. FIGS. 25A, 25B and 25C are views illustrating a scan clock, a sense clock, and a carry clock of a seventh clock signal group GCLK7, respectively. FIGS. 26A, 26B and 26C are views illustrating a scan clock, a sense clock, and a carry clock of an eighth clock signal group GCLK8. In FIGS. 19A, 19B, 19C, 20A, 20B, 20C, 21A, 21B, 21C, 22A, 22B, 22C, 23A, 23B, 23C, 24A, 24B, 24C, 25A, 25B, 25C, 26A, 26B, and 26C, the clock signals indicated with hatching are clock signals for determining a timing of the BDI scan signal SCB, and the clock signals without hatching are clock signals for determining a timing of the image scan signal SCI.

The timing controller 200 applies any one of the first to eighth clock signal groups GCLK 1 to GCLK 8 to the shift register 500 during one frame.

Referring to FIGS. 19A, 19B, 19C, 20A, 20B, 20C, 21A, 21B, 21C, 22A, 22B, 22C, 23A, 23B, 23C, 24A, 24B, 24C, 25A, 25B, 25C, 26A, 26B, and 26C, one clock cycle may be set to 40 horizontal periods (40H) including an image data write period, a black image data insertion period, and a precharge period. In other words, the ¼ clock cycle includes an image data write period of 8 horizontal periods (8H), a black image data insertion period BDI of 1 horizontal period (1H), and a precharge period PC of 1 horizontal period. 10 horizontal periods (10H) of the ¼ clock cycle thus configured are repeated three times further to drive 32 pixel lines during one clock cycle.

Phases of the IDW/SDW carry clocks, the BDI carry clocks, the IDW/SDW scan clocks, and the IDW/SDW sense clocks are synchronized with each other, and phases of the BDI scan clocks and the IDW/SDW scan clocks are set to be different from each other. Accordingly, IDW driving and BDI driving are performed separately in the region A and the region B, while a pulse interval of the BDI scan clocks and a pulse interval of the IDW/SDW scan clocks do not overlap each other. In other words, the timing controller 200 may drive the region B to be BDI-driven, while IDW driving is performed on the region A, and conversely, the timing controller 200 may drive the region B to be IDW-driven, while BDI driving is performed on the region A. Accordingly, undesired data intermingling between the input image data ID and the black image data BD may be prevented in the technique of improving the MPRT performance by inserting a black image.

As illustrated in FIGS. 19A, 19B, 19C, 20A, 20B, 20C, 21A, 21B, 21C, 22A, 22B, 22C, 23A, 23B, 23C, 24A, 24B, 24C, 25A, 25B, 25C, 26A, 26B, and 26C, the carry clock CRCLK, the scan clock SCCLK, and the sense clock SECLK belonging to each of the first to eighth clock signal groups may be 16-phase clocks in which the phase change number per clock is 32. The carry clock CRCLK is synchronized with the carry signal, the scan clock SCCLK is synchronized with the scan signal, and the sense clock SECLK is synchronized with the sense signal. These clocks may have 40 horizontal periods 40H as one clock cycle.

Each of the carry clocks CRCLK belonging to the first to eighth clock signal groups has first to fourth pulse intervals (ON voltage intervals) within one clock cycle. Each of the first to fourth pulse intervals may be two horizontal periods (2H). The first and second pulse intervals of each of the carry clocks CRCLK are IDW/SDW carry clocks, and the third and fourth pulse intervals are BDI carry clocks. The IDW/SDW carry clocks and the BDI carry clocks are alternately output.

BDI carry clocks of the first clock signal group GCLK1 are output between a data write period of the 8k-th pixel line and a data write period of the (8k+1)-th pixel line. BDI carry clocks of the second clock signal group GCLK2 are output between the data write period of the (8k+1)-th pixel line and a data write period of the (8k+2)-th pixel line. BDI carry clocks of the third clock signal group GCLK3 are output between the data write period of the (8k+2)-th pixel line and a data write period of the (8k+3)-th pixel line. BDI carry clocks of the fourth clock signal group GCLK4 are output between the data write period of the (8k+3)-th pixel line and a data write period of the (8k+4)-th pixel line. BDI carry clocks of the fifth clock signal group GCLK5 are output between the data write period of the (8k+4)-th pixel line and a data write period of the (8k+5)-th pixel line. BDI carry clocks of the sixth clock signal group GCLK6 are output between the data write period of the (8k+5)-th pixel line and a data write period of the (8k+6)-th pixel line. BDI carry clocks of the seventh clock signal group GCLK7 are output between the data write period of the (8k+6)-th pixel line and a data write period of the (8k+7)-th pixel line. BDI carry clocks of the eighth clock signal group GCLK8 are output between the data write period of the (8k+7)-th pixel line and a data write period of the (8k+8)-th pixel line.

Each of the scan clocks SCCLK has first to fourth pulse intervals (ON voltage intervals) within one clock cycle. The first and second pulse intervals may each be two horizontal periods (2H), and the third and fourth pulse intervals may each be one horizontal period (1H). The first and second pulse intervals are IDW/SDW scan clocks, and the third and fourth pulse intervals are BDI scan clocks. The IDW/SDW scan clocks and the BDI scan clocks are alternately output.

Each of the sense clocks SECLK has two pulse intervals (ON voltage interval) within one clock cycle. These pulse intervals may each be two horizontal periods (2H) and are IDW/SDW sense clocks.

The timing controller 200 may determine a timing of the BDI period by selecting any one of the first to eighth clock signal groups. In particular, the timing controller 200 according to the present disclosure may vary the clock signal groups applied to the shift register on a frame-by-frame basis. That is, the timing controller 200 may make a timing of the BDI period different for each frame.

Figure 27:
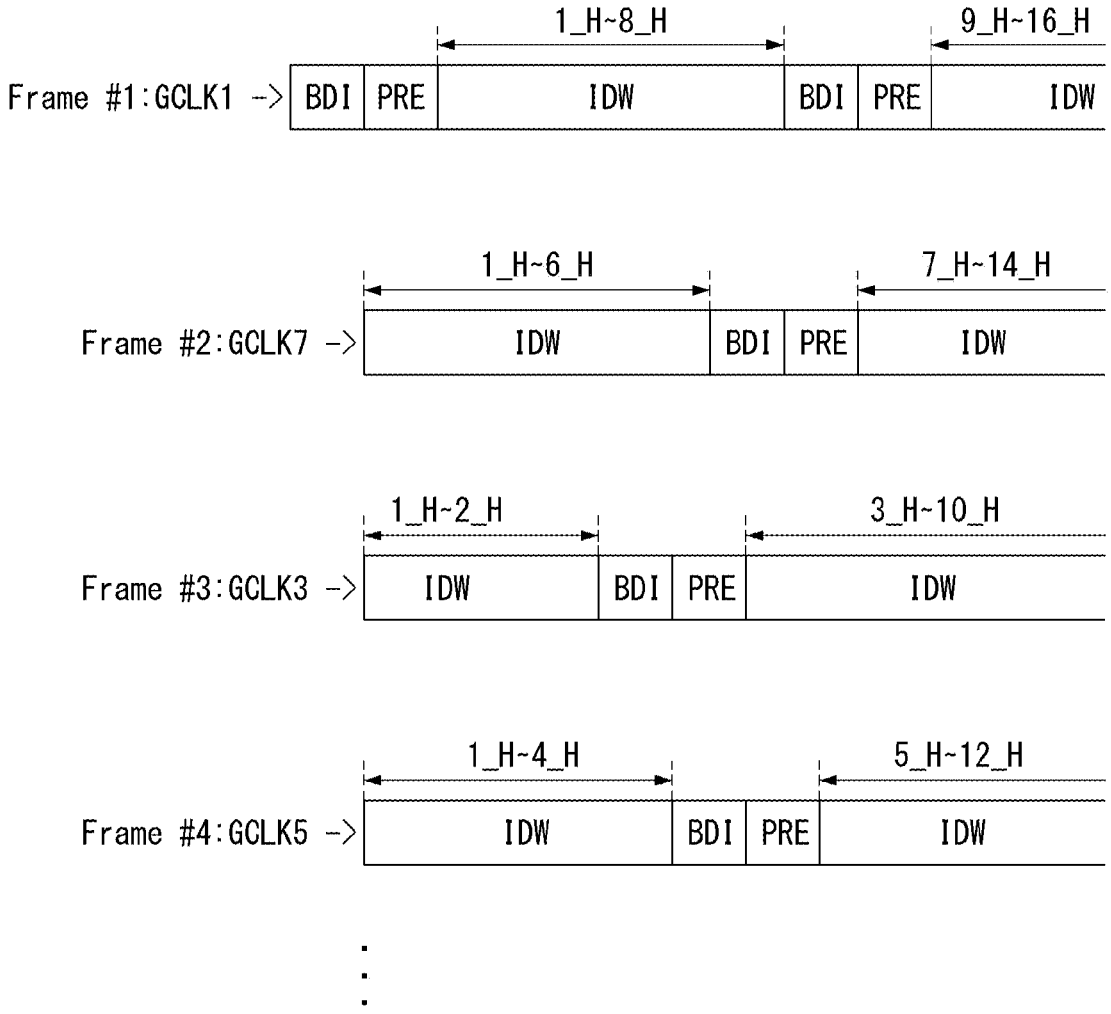
FIG. 27 is a view illustrating that a timing controller changes a BDI driving period.

FIG. 27 is a view illustrating an embodiment in which the timing controller 200 selects a clock signal group and changes a timing of the BDI period.

Referring to FIG. 27, the timing controller 200 outputs different clock signal groups for each frame. Hereinafter, in this disclosure, i-th (I is a natural number of n or smaller) horizontal period i_H refers to a programming interval for writing data for image displaying in i-th pixel line. Since the data for image displaying is not written during the precharge interval and the BDI interval, the (i−1)-th horizontal period i−1_H and the i-th horizontal period i_H may not be contiguous with each other.

For example, the timing controller 200 outputs the first clock signal group GCLK1 during a first frame Frame #1. As a result, the BDI is performed after the 8i-th horizontal period 8i_H terminates in the first frame Frame #1. The timing controller 200 outputs the seventh clock signal group GCLK7 during a second frame. As a result, BDI is performed after (8i+6)-th horizontal period. According to the present disclosure, a timing at which the BDI period arrives for each frame is varied, thereby improving concentration of brightness deviation among certain pixel lines.

A pixel line on which luminance deviation is concentrated corresponds to pixel lines that are driven during a horizontal period adjacent to the BDI period, and the reason for this is as follows.

Figure 28:
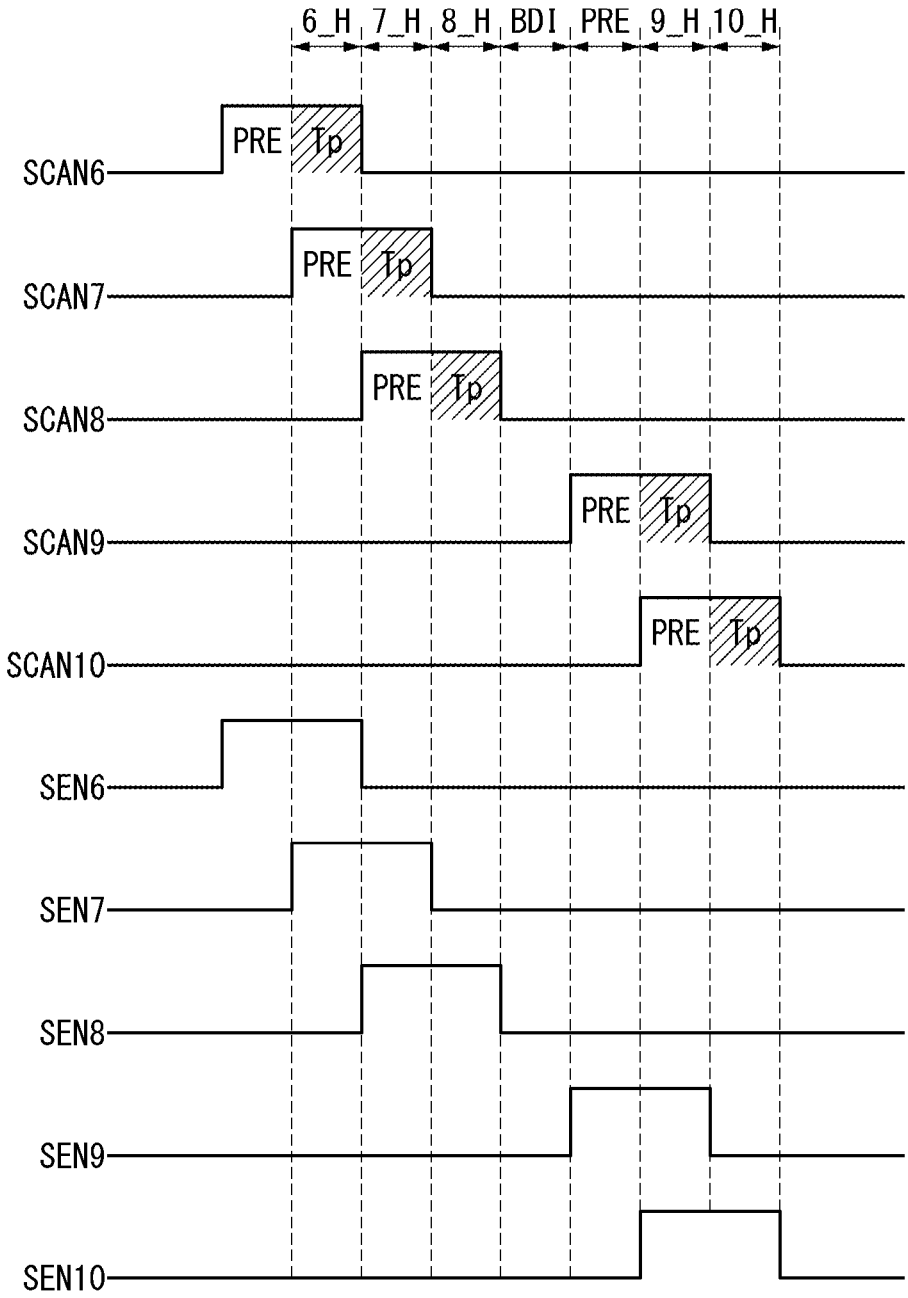
FIGS. 28 and 29 are views illustrating the occurrence of a reference voltage deviation in a horizontal period adjacent to a BDI driving period.
Figure 29:
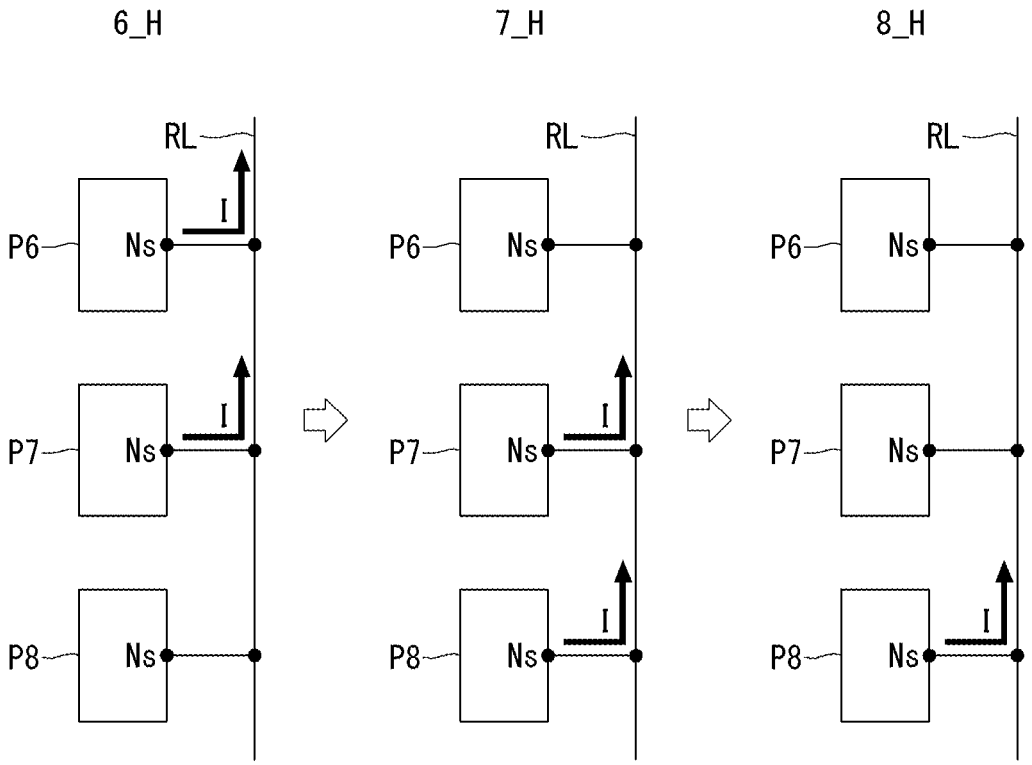

FIG. 28 is a view illustrating timings of clock signals that go through the BDI period and the precharge period subsequent to the eighth horizontal period. FIG. 29 is a view illustrating IR voltage deviation of pixel lines driven on the basis of FIG. 28.

As illustrated in FIGS. 28 and 29, when overlap driving is performed, a programming interval Tp of the i-th pixel i (i is a natural number of n or smaller) and a precharge period PRE of the (i+1)-th pixel overlap. For example, the programming interval Tp of the sixth pixel P6 and the precharge period PRE of the seventh pixel P7 overlap in the sixth horizontal period 6_H. Here, since the period after the eighth horizontal period 8_H in the first image data write interval IDW1 is the BDI interval, the programming interval Tp of the eighth pixel 8P does not overlap the precharge period of the ninth pixel 9P.

During the sixth horizontal period 6_H, the sixth and seventh sense signals SEN6 and SEN7 are turn-on voltages and accordingly current flows between the second nodes Ns of the sixth and seventh pixels P6 and P7 Ns and the reference voltage line RL. As a result, the second node Ns of the sixth pixel P6 and the second node Ns of the seventh pixel P7 are set with a voltage reflecting the "IR deviation" having the size of "2I×R" in the reference voltage Vref. Here, "I" refers to a current value flowing to the second node Ns of each of the pixels from the reference voltage line RL, and "R" refers to a resistance value of the reference voltage line RL.

During the seventh horizontal period 7_H, the seventh and eighth sense signals SEN7 and SEN8 are turn-on voltages, and accordingly, current flows between the second nodes Ns of the seventh and eighth pixels P7 and P8 and the reference voltage line RL. As a result, the second node Ns of the seventh pixel P7 and the second node Ns of the eighth pixel P8 are set with a voltage reflecting "IR deviation" having a size of "2I×R" in the reference voltage Vref.

During the eighth horizontal period 8_H, the eighth sense signal SEN is a turn-on voltage, and accordingly, current flows between the second node Ns of the eighth pixel P8 and the reference voltage line RL. The second node Ns of the eighth pixel P8 is set with a voltage reflecting "IR deviation" having a size of "I×R" in the reference voltage Vref.

As described above, the second node Ns of the sixth pixel P6 and the second node Ns of the seventh pixel P7 are programmed in a state of having the voltage deviation of "2I×R" from the reference voltage Vref. Meanwhile, the second node Ns of the eighth pixel P8 is programmed in a state of having the "IR deviation" having the size of "I×R". Thus, although the same data voltage is applied to the sixth to eighth pixels P6 to P8, the eighth pixel P8 programmed in the eighth horizontal period 8-H represents different brightness as compared with the sixth and seventh pixels P6 and P7.

Also, in a state in which the black data voltage having a low voltage level is applied to the display panel 100 during the BDI period, an image data voltage is applied during a subsequent precharge period PRE. In this case, a coupling phenomenon occurs in the display panel 100 during the ninth horizontal period 9_H, and as a result, the reference voltage Vref applied to the reference voltage line RL also increases.

The eighth pixel P8 and the ninth pixel P9 in which the data voltage is written during the eighth horizontal period 8_H and the ninth horizontal period 9_H adjacent to the BDI period has a reference voltage Vref deviation as compared with other pixels, and as a result, brightness deviation occurs. Here, if the BDI period is fixed, a line dim phenomenon occurs because the pixel lines in which brightness deviation occurs are fixed.

In contrast, according to the present disclosure, as illustrated in FIG. 27, since the BDI period is varied on a frame-by-frame basis, a line in which brightness deviation occurs may be continuously changed. As a result, concentration of brightness deviation on a specific line may be prevented, thereby preventing occurrence of the line dim phenomenon.

In particular, the timing controller 200 may irregularly change the BDI period, whereby a line in which brightness deviation occurs may be prevented from being visually recognized by the naked eyes.

Figure 30:
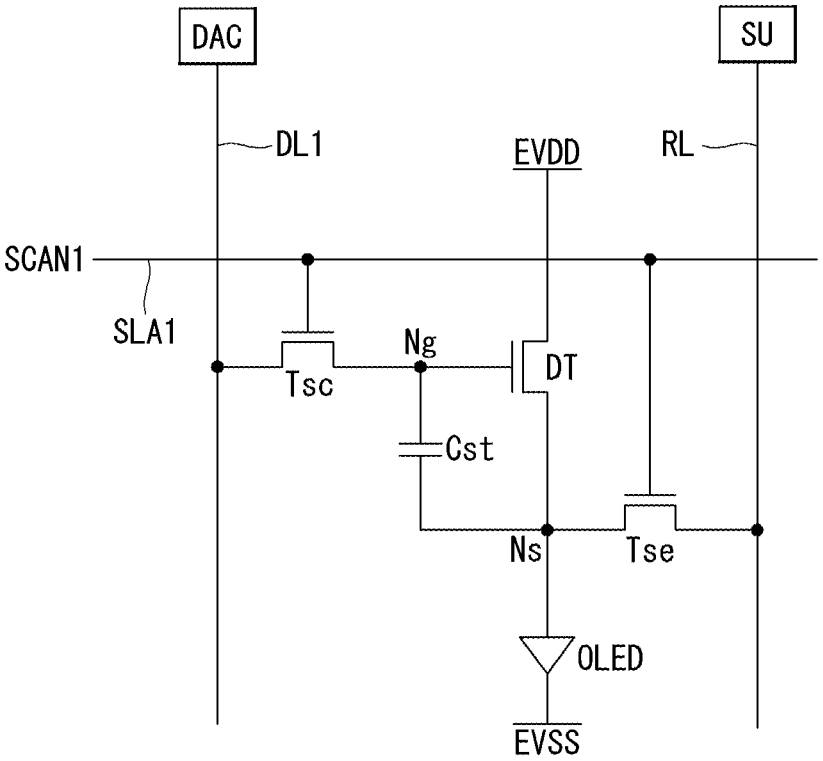
FIG. 30 is a view illustrating a pixel structure according to a second embodiment.
Figure 31:
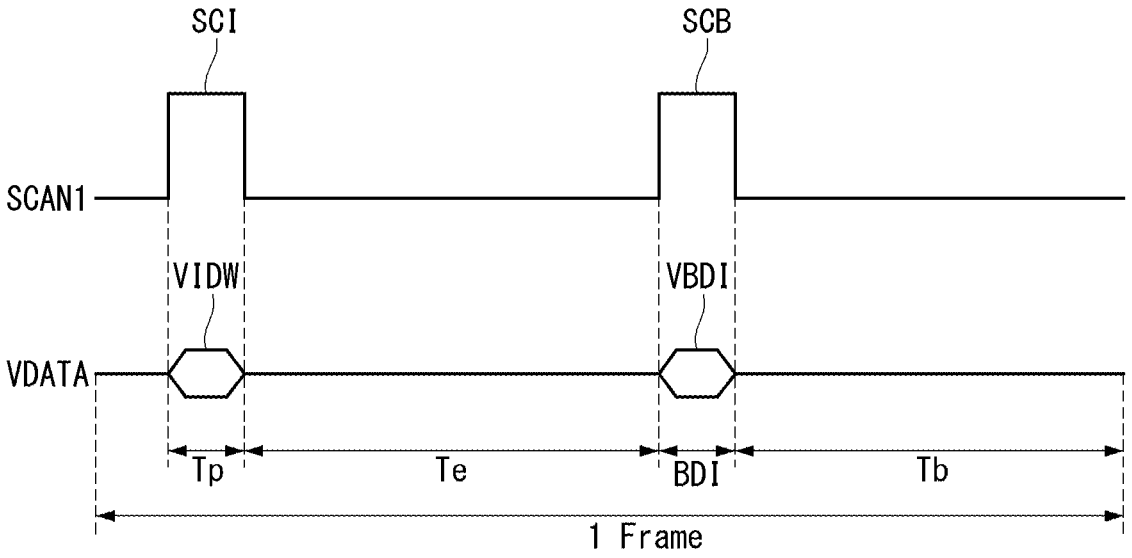
FIG. 31 is a view illustrating a gate signal for driving a pixel illustrated in FIG. 30.

FIG. 30 is a view illustrating a pixel structure according to a second embodiment, and FIG. 31 is a view illustrating a driving signal for driving the pixel structure illustrated in FIG. 30. FIG. 30 shows a pixel connected to the first data line among the pixels arranged in the first pixel line. In the second embodiment, the gate line includes a scan line for applying a scan signal.

Referring to FIGS. 30 and 31, a pixel P includes an organic light emitting diode OLED, a driving transistor DT, a storage capacitor Cst, a scan transistor Tsc, and a sense transistor Tse. The driving transistor DT controls a driving current flowing at the organic light emitting diode OLED according to the gate-source voltage Vgs. The driving transistor DT includes a gate electrode connected to the first node Ng, a drain electrode connected to the input terminal of the high potential driving voltage EVDD, and a source electrode connected to the second node Ns. The storage capacitor Cst is connected between the first node Ng and the second node Ns. The scan transistor Tsc includes a gate electrode connected to the scan line SLA, a drain electrode connected to the first data line DL1, and a source electrode connected to the first node Ng. The sense transistor Tse includes a gate electrode connected to the scan line SLA, a drain electrode connected to the second node Ns, and a source electrode connected to the reference voltage line RL.

The first data line DL1 is supplied with a data voltage through a digital-to-analog converter (DAC) of the data driver 300 and the reference voltage line RL is connected to a sensing unit SU. The sensing unit SU supplies the reference voltage through the reference voltage line RL of the pixel or acquires a voltage of the first node Ng of each of the pixels as a sensing voltage.

The pixel structure according to the second embodiment is controlled by a scan signal SCAN provided to both the scan transistor Tsc and the sense transistor Tse through the scan line SLA. That is, in the display device using the pixel structure of the second embodiment, since the number of gate lines is reduced, the number of clock lines for applying the clock signal in the shift register may be reduced. As a result, the size of the non-display area NAA of the display panel 100 may be reduced.

Figure 32:
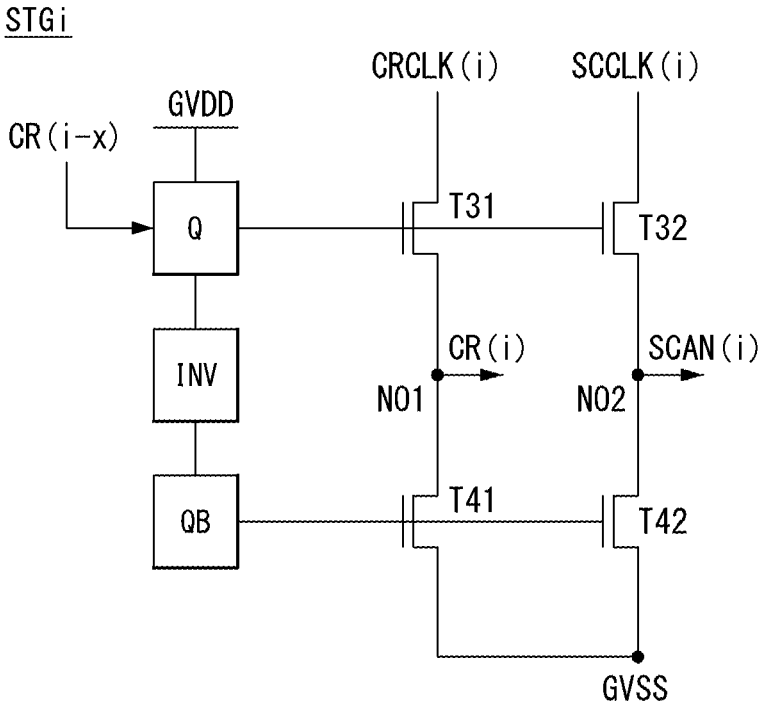
FIG. 32 is a view illustrating a configuration of a stage according to the second embodiment.

FIG. 32 is a schematic view of one stage of a shift register for generating a scan signal for driving a pixel circuit according to the second embodiment. In FIG. 32, the same reference numerals are used for the components substantially the same as those illustrated in FIG. 16, and a detailed description thereof will be omitted.

Referring to FIG. 32, i-th (i is an integer) stage STGi includes first and second pull-up transistors for outputting clock signals CRCLK, SCCLK, and SECLK as gate signals according to a voltage of the node Q and first and second pull-down transistors T41 and T42 for discharging the output terminals NO1 and NO2 to the low potential power supply voltage GVSS according to a voltage of the node QB.

The stage illustrated in FIG. 32 may be regarded as a structure in which the third pull-up transistor T33 and the third pull-down transistor T43 in the stage illustrated in FIG. 16 are omitted.

As the carry clock CRCLK and the scan clock SCCLK applied to the shift register according to the second embodiment, the same signals as those of the carry clock CRCLK and the scan clock SCCLK applied to the first embodiment described above may be used.

Also, the timing controller 200 may determine a BDI timing using any one of the first gate clock group GCLK 1 to the eighth gate clock group GCLK 8. In addition, the timing controller 200 may make the BDI timing different in each frame by changing the gate clock group applied to the shift register for each frame. As a result, the occurrence of the line dim phenomenon in the fixed pixel line may be improved.

Figure 33:
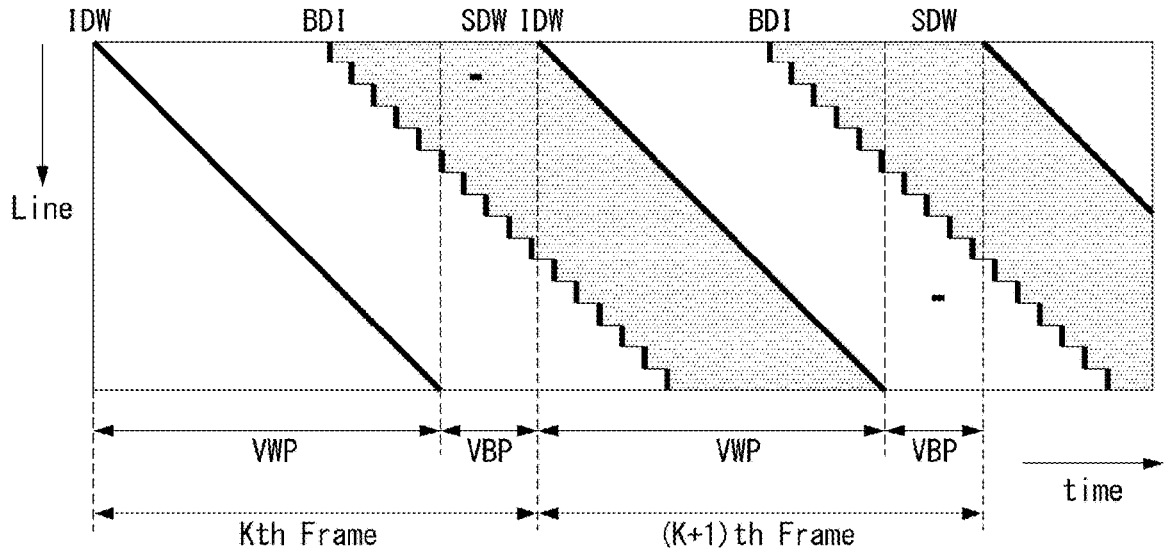
FIGS. 33 and 34 are views illustrating a timing for performing real-time sensing in a black image inserting technique.
Figure 34:
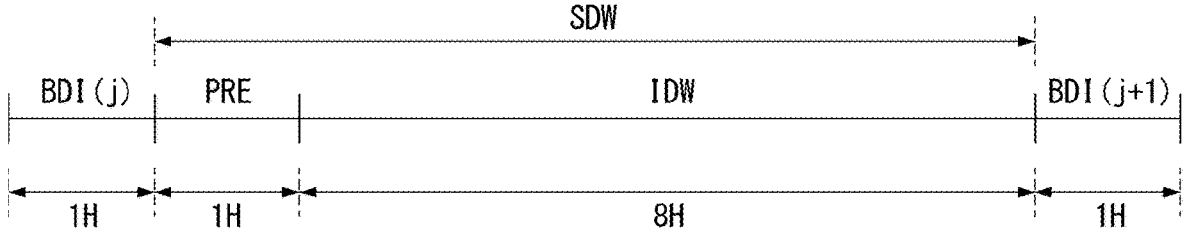

FIGS. 33 and 34 are views illustrating real-time sensing performed during a vertical blanking period in a pixel structure according to the second embodiment.

Referring to FIGS. 33 and 34, the timing controller 200 may implement IDW driving in a vertical active period VWP of each frame on the basis of the timing control signals GDC and DDC and implement SDW driving in the vertical blanking period VBP of each frame. Also, the timing controller 200 may implement BDI driving through some vertical active periods VWP and vertical blanking periods VBP of the k-th frame and some vertical active periods VWP of the (k+1)-th frame. Since the vertical blanking period VBP is significantly shorter than the vertical active period VWP, SDW driving may be performed on a particular pixel line for a much shorter time than IDW driving and BDI driving.

An SDW driving period is set within a range that does not overlap a BDI driving period. For example, as illustrated in FIG. 34, the SDW driving period may be disposed between j-th BDI driving period BDISince the scan line SLA and the sense line SLB are separated from each other in the pixel structure according to the first embodiment illustrated in FIG. 2, the sense transistor Tse of the pixels for writing black data may not be turned on and the sense transistor Tse of the pixel to be sensed may be turned on during the BDI driving period. As a result, in the pixel structure according to the first embodiment, although the SDW driving period overlaps the BDI driving period, the phenomenon that a sensed voltage in the reference voltage line RL is lost does not occur.

In contrast, in the second embodiment, the scan transistor Tsc and the sense transistor Tse are simultaneously turned on during the SDW driving period or the BDI driving period. Therefore, when the SDW driving period overlaps the BDI driving period, the sense transistors Tse of the pixels other than the pixels sensed during a sensing operation are turned on and the sensed voltage in the reference voltage line RL is lost. Therefore, in the structure of the second embodiment illustrated in FIG. 30, SDW driving is performed between adjacent BDI driving periods.

Also, the timing controller 200 changes the SDW driving period at every frame. When the BDI driving period is changed in each frame, if the SDW driving period is fixed, it may conflict with the BDI driving period. For example, when the BDI driving period is varied as illustrated in FIG. 27, the SDW driving period may fall between the first horizontal period 1_H and the eighth horizontal period 8_H in the first frame Frame #1. If the SDW driving period is fixed, a problem arises in that the BDI driving period and the SDW driving period overlap each other in the second frame Frame #2. Therefore, the timing controller 200 varies the SDW driving period in each frame, and here, the timing controller 200 places the SDW driving period between adjacent BDI driving periods as illustrated in FIG. 34.

The embodiments of the present disclosure have the following effects.

According to the black image insertion technique of the present disclosure, since a clock line for writing an input image and a clock line for writing a black image are not separated but commonly used, there is no need to increase the bezel area and a narrow bezel may be advantageously implemented.

According to the black image insertion technique of the present disclosure, since the input image and the black image are written in an overlapping manner with a predetermined time difference in the same frame, there is no need to increase one frame time and high-speed driving may be achieved.

According to the black image insertion technique of the present disclosure, since the black image is simultaneously written in units of a plurality of pixel lines, a time for writing the black image in one frame may be reduced and a time for writing the input image may be sufficiently secured.

According to the black image insertion technique of the present disclosure, a pixel array is divided into one or more regions A and one or more regions B, images having different properties (that is, an input image and a black image) are written into the region A and the region B in an overlapping manner, and a phase of a gate shift clock synchronized with an input image write timing and a phase of a gate shift clock synchronized with a black data write (BDI) timing are separated, thereby preventing data intermingling (data collision) due to overlap driving.

In the present disclosure, since the scan transistor and the sense transistor are controlled using the same scan signal, the number of clock lines for generating scan signals may be reduced and a sensing operation may be performed by avoiding the BDI driving period.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including first and second pixel line groups, each of the first and second pixel groups including k pixel lines, k being a natural number greater than 1, each of the k pixel lines including a plurality of pixels electrically connected to a same gate line;

a data driver configured to supply an image data voltage to the plurality of pixels of each of the k pixel lines on the basis of input image data;

a gate driver configured to supply a gate pulse to the gate line; and a timing controller configured to control a driving timing of the data driver and the gate driver to sequentially supply the image data voltage to pixel lines belonging to the first pixel line group during an image data write period, and to concurrently supply a black data voltage to pixel lines belonging to the second pixel line group during a black data insertion (BDI) period, wherein the timing controller is further configured to:

change, on a frame-by-frame basis, an interval between timings for supplying the black data voltage from a start timing of a frame; and perform control to write a data voltage for sensing between mutually adjacent timings for writing a black image.

2. The display device of claim 1, wherein the timing controller is configured to select an interval between timings for writing a first black image from the start timing of the frame from within a range of zero horizontal periods to n−1 horizontal periods, n being a natural number greater than 1.

3. The display device of claim 2, wherein the timing controller is configured to control a time difference between timings for writing the first black image in mutually adjacent frames to be varied in each frame.

4. The display device of claim 1, wherein the timing controller is configured to drive k or less pixel lines during a first image data write period from a start time point of each frame, and drive k pixel lines during a second image data write period.

5. The display device of claim 1, wherein each of the plurality of pixels of each of the k pixel lines includes:

a driving transistor configured to control a driving current of an organic light emitting diode (OLED);

a scan transistor configured to electrically connect a gate electrode of the driving transistor to a data line in response to a scan signal; and a sense transistor configured to electrically connect a source electrode of the driving transistor to a reference voltage line in response to the scan signal, wherein the timing controller is configured to control a period for writing data for sensing into the data line and a period for writing the black image into the data line not to overlap each other.

6. The display device of claim 5, wherein the timing controller is configured to control a timing for supplying a first data voltage for sensing to be varied in each frame.

7. The display device of claim 1, wherein the timing controller is configured to provide n pixel lines into which the image data voltage is sequentially supplied, clock signals having the same cycle as those of pixel lines into which the black data voltage is concurrently supplied and having different phases, and the clock signals include a clock signal for an image synchronized with a timing at which the image data voltage or a data voltage for sensing is applied, and a clock signal for BDI synchronized with the timings for supplying the black data voltage.

8. The display device of claim 7, wherein the timing controller is configured to control the clock signal for the image and the clock signal for the BDI to not overlap each other.

9. The display device of claim 8, wherein the timing controller is configured to control a timing for outputting a first clock signal for the BDI to be varied in each of a plurality of frames.

* * * * *